US007975881B1

(12) United States Patent
Glucksman et al.

(10) Patent No.: US 7,975,881 B1
(45) Date of Patent: Jul. 12, 2011

(54) BEVERAGE DISPENSER

(75) Inventors: Dov Z Glucksman, Danvers, MA (US); Laura J Nickerson, Fitchburg, MA (US); Gary P McGonagle, Lynn, MA (US); Ulrich Bernard Schnacke, Weddington, NC (US)

(73) Assignee: Appliance Development Corporation, Danvers, MA (US)

( * ) Notice: Subject to any disclaimer, the term of this patent is extended or adjusted under 35 U.S.C. 154(b) by 1094 days.

(21) Appl. No.: 11/624,594

(22) Filed: Jan. 18, 2007

Related U.S. Application Data

(63) Continuation-in-part of application No. 10/906,214, filed on Feb. 9, 2005, now abandoned.

(51) Int. Cl.
*B65D 37/00* (2006.01)
*B67D 7/80* (2010.01)
*F25D 25/04* (2006.01)

(52) U.S. Cl. ..... 222/209; 222/146.6; 222/401; 222/183; 221/150 R

(58) Field of Classification Search ..... 222/129.1, 222/129.2, 129.3, 129.4, 389, 146.1, 146.2, 222/146.6, 401, 402, 182, 475.1, 632, 633, 222/631, 630, 209, 214, 465.1, 137, 538, 222/211, 183, 130, 131, 105; 62/342, 343; 99/467; 221/150 R
See application file for complete search history.

(56) References Cited

U.S. PATENT DOCUMENTS

| | | | | |
|---|---|---|---|---|
| 1,530,074 | A | | 9/1924 | Eckert |
| 2,929,535 | A | | 3/1960 | Fairbanks |
| 2,947,150 | A | | 8/1960 | Roeder, Jr. |
| 3,195,315 | A | | 7/1965 | Boehmer et al. |
| 3,305,132 | A | | 2/1967 | Coja |
| 3,438,214 | A | | 4/1969 | Schmittle |
| 3,713,302 | A | | 1/1973 | Reviel |
| 3,721,370 | A | | 3/1973 | Blum |
| 3,732,702 | A | | 5/1973 | Desch |
| 3,823,567 | A | | 7/1974 | Corini |
| 4,260,078 | A | | 4/1981 | Kephart |
| 4,320,626 | A | | 3/1982 | Donnelly |
| 4,364,234 | A | | 12/1982 | Reed |
| 4,436,227 | A | | 3/1984 | Johnson, Jr. et al. |
| 4,453,385 | A | | 6/1984 | May |
| 4,541,251 | A | * | 9/1985 | Louradour et al. ..... 62/64 |
| 4,622,822 | A | | 11/1986 | Beitner |
| 4,667,856 | A | | 5/1987 | Nelson |
| 4,844,290 | A | | 7/1989 | McCurdy et al. |
| 4,856,680 | A | * | 8/1989 | Sitton ..... 222/152 |
| 4,972,973 | A | | 11/1990 | Davis |
| 5,114,045 | A | | 5/1992 | Herpe |
| 5,131,568 | A | | 7/1992 | Ringuette |
| 5,207,148 | A | | 5/1993 | Anderson et al. |
| 5,226,298 | A | | 7/1993 | Yamamoto et al. |
| 5,282,364 | A | | 2/1994 | Cech |
| 5,301,508 | A | | 4/1994 | Kahl et al. |
| 5,544,489 | A | | 8/1996 | Moren |

(Continued)

FOREIGN PATENT DOCUMENTS

DE 9307040 U1 7/1993

*Primary Examiner* — Kevin P Shaver
*Assistant Examiner* — Stephanie E Williams

(57) ABSTRACT

A refrigerated beverage dispenser. A beverage container is carried in a covered refrigerated housing that includes a heat exchanger for maintaining beverage at a predetermined temperature. A dispensing tube provides a conduit for the beverage. To dispense the liquid, a pressure differential is produced whereby the pressure on the liquid in the container is greater than the pressure at a dispensing port.

29 Claims, 31 Drawing Sheets

U.S. PATENT DOCUMENTS 5,572,872 A 11/1996 Hlavacek
5,636,766 A 6/1997 Delameter et al.
5,752,624 A 5/1998 Vinson et al.
5,927,085 A 7/1999 Waldman
6,026,988 A 2/2000 Teetsel, III et al.
6,141,969 A 11/2000 Launchbury et al.
6,182,863 B1 2/2001 Van Der Meer et al.
6,370,883 B1 4/2002 Kugel
6,523,364 B1 2/2003 Pader
6,571,564 B2 6/2003 Upadhye et al.
6,607,100 B2 8/2003 Phelps et al.
6,729,500 B1 5/2004 Dobbs et al.
6,820,774 B2 11/2004 Jones
6,913,167 B2 * 7/2005 Phelps et al. ..... 222/152
2002/0139815 A1 10/2002 Tansley et al.
2003/0213814 A1 11/2003 Phelps et al.

* cited by examiner

BEVERAGE DISPENSER

CROSS REFERENCE TO RELATED APPLICATION

This application is a continuation-in-part of co-pending application for U.S. patent Ser. No. 10/906,214 filed Feb. 9, 2005 for a Beverage Dispenser.

BACKGROUND OF THE INVENTION

1. Field of the Invention

This invention generally relates to beverage dispensers. More specifically this invention relates to beverage dispensers that control the temperature of a beverage.

2. Description of Related Art

The prior art discloses a wide range of dispensers that control the temperature of a beverage. These are used in several applications.

For example, U.S. Pat. No. 5,207,148 discloses an automated milk inclusive coffee apparatus with a steam generator that drives a Venturi mixing device. The Venturi mixing device draws milk from a refrigerated source for making milk inclusive espresso beverages. The refrigerated source includes a Peltier refrigeration unit and an air circulation device within an insulated housing.

U.S. Pat. No. 5,572,872 discloses a liquid cooling, storing and dispensing device formed by a covered refrigerated unit with a Peltier thermoelectric refrigeration device, as one example of a heat exchanger, connected to a wall that abuts a carton. In this particular device, a consumer uses a handle on the device to manipulate the dispensing device and container and pour the contents.

U.S. Pat. No. 6,182,863 discloses a beverage dispensing apparatus with a refrigeration structure for carrying a flexible beverage container. Pressure is exerted against the outer surface of the flexible beverage container. This compresses the container and forces the beverage toward a valve. A consumer opens the valve to dispense liquid. The container can be under pressure even when the valve is closed.

U.S. Pat. No. 6,370,883 discloses a device for the thermal control of liquids or beverages contained in a vessel located in a refrigerated container surrounded by a cooling medium in thermal contact with a Peltier thermoelectric refrigeration device. A pump connects to vessel and includes a piston and valves. Operation of the pump compresses air causing the liquid or beverage to be dispensed.

U.S. Pat. No. 6,820,774 discloses a non-refrigerating beverage dispensing device that includes a cap for attachment to a beverage container. The cap defines an outlet. An inner tube attaches the cap for insertion into the container and is in communication with the outlet. A second tube extends from the cap to provide selective pumping of air into the container through the inner tube. A valve on an outer tube controls liquid flow which occurs essentially in a siphoning mode.

These and other prior art beverage dispensers have been used in a variety of applications. Recently, however, the popularity of coffee shops has increased dramatically. Some of them have certain requirements that the foregoing and other prior art beverage dispensers do not meet. More specifically, different coffee shops operate in accordance with different business models. In some, the customer orders coffee with the additions of sweeteners or dairy products by coffee shop personnel. In another popular business model to which this invention is particularly adapted, the customer obtains coffee in a cup and then moves to another part of the store to add dairy products and sweeteners. In many facilities using this business model it is highly desirable that the dairy products be fresh for marketing purposes and for overall taste.

This business model has generated certain requirements for dispensing such dairy-like products. For example, any such dispenser must refrigerate the dairy product or beverage in bulk rather than containers for individual portions without the dairy product spoiling over time. Such dispensers must be easy to clean and easy to fill by coffee shop personnel. Customers must find these dispensers easy to use without spilling the dairy product. While prior art devices satisfy some of these requirements, they do no satisfy all of them. What is needed is a refrigerated beverage dispenser that preserves any beverage for prolonged periods of time to minimize spoilage with its attendant costs and that is easy to use by both consumers and coffee shop personnel.

SUMMARY

Therefore it is an object of this invention to provide a beverage dispenser that refrigerates a beverage, or liquid, and dispenses the beverage in a controlled manner.

Another object of this invention is to provide a refrigerated beverage dispenser for a beverage, or liquid, that minimizes cleaning operations.

Another object of this invention is to provide a refrigerated beverage dispenser that is affordable for use in coffee shops and like businesses.

In accordance with one aspect of this invention, apparatus for dispensing the contents of a liquid container comprises a refrigerated housing for receiving the container. First and second ports are formed in the liquid container. A dispenser extends from the interior of the liquid container to a dispensing outlet at the exterior of the housing through the first port. Apparatus for producing a pressure differential attaches to the housing and includes the second port whereby the pressure acting on the liquid in the container can be increased over the pressure at the dispensing outlet. Consequently, operation of this pressure differential apparatus dispenses liquid from the liquid container at the dispensing outlet.

In accordance with another aspect of this invention a disposable apparatus for use with a liquid dispenser that receives a replaceable liquid container with an opening at its top portion and that directs the liquid from the container to a dispensing location in response to the generation of a pressure differential includes a structure that attaches to the top portion adjacent the opening for defining first and second ports. A structure for directing liquid has a first tubular portion that extends through the first port into the liquid container. A second tubular portion extends exteriorly of the port structure to the dispensing location. The second port connects to the pressure generating apparatus. Operating of the pressure generating apparatus thereby causes the liquid to flow from the liquid container through the liquid directing apparatus to the dispensing location.

In accordance with still another aspect of this invention a disposable apparatus is adapted for use with a liquid dispenser that receives a replaceable liquid container with an opening at its top portion thereof. The disposable apparatus directs liquid from the container to a dispensing location in response to operation of a pressure generating means. The disposable apparatus includes a stopper that attaches to the top portion adjacent the opening for defining first and second ports therethrough. A liquid director conveys the liquid to a dispensing outlet. It has a first portion for extending through said first port into the liquid container and a second portion for extending exteriorly of said first port to the dispensing location. The second port connects to the pressure generating means.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

First Embodiment

Figure 1:
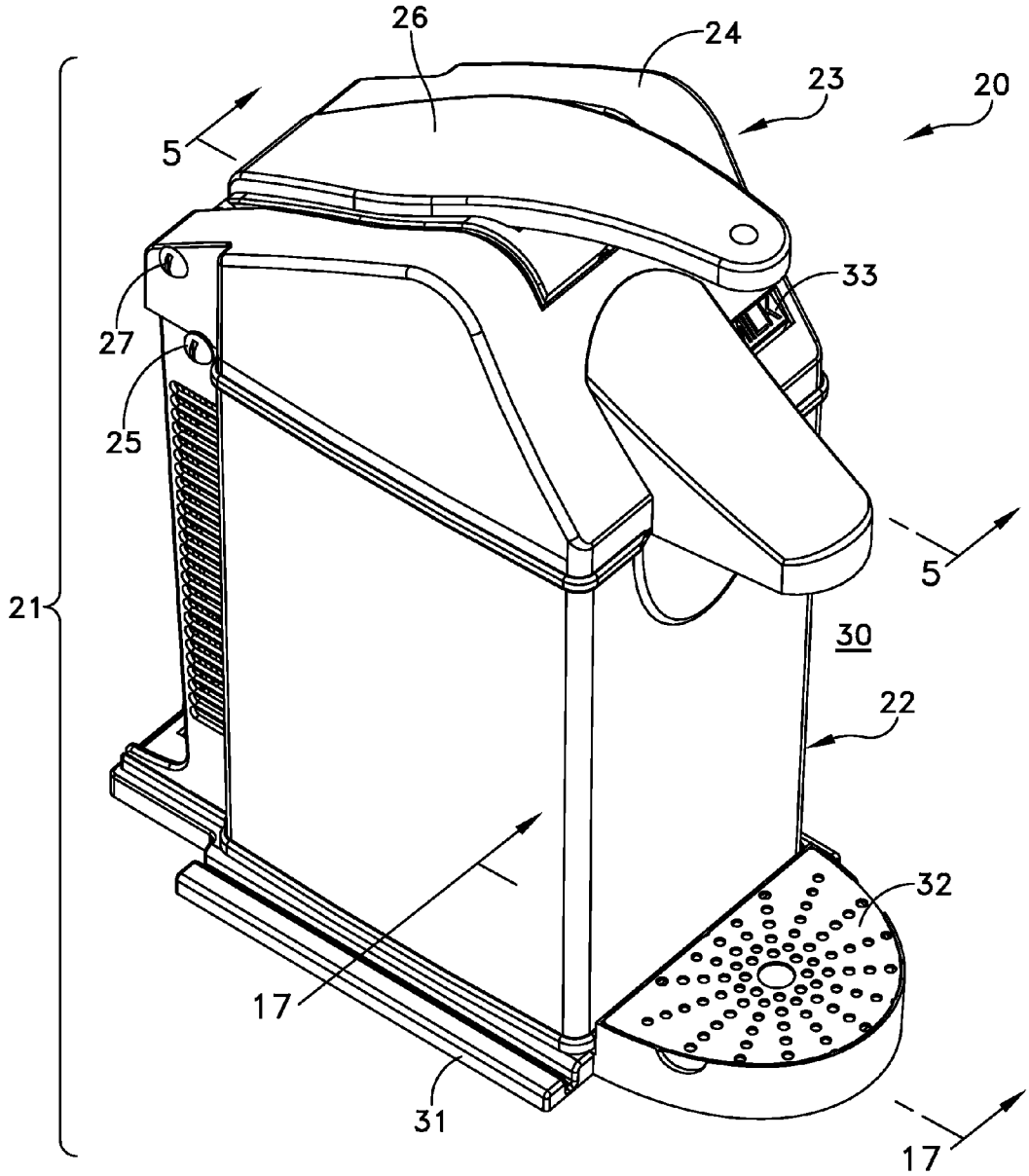
FIG. 1 is a perspective view of a beverage dispenser constructed in accordance with this invention.
Figure 2:
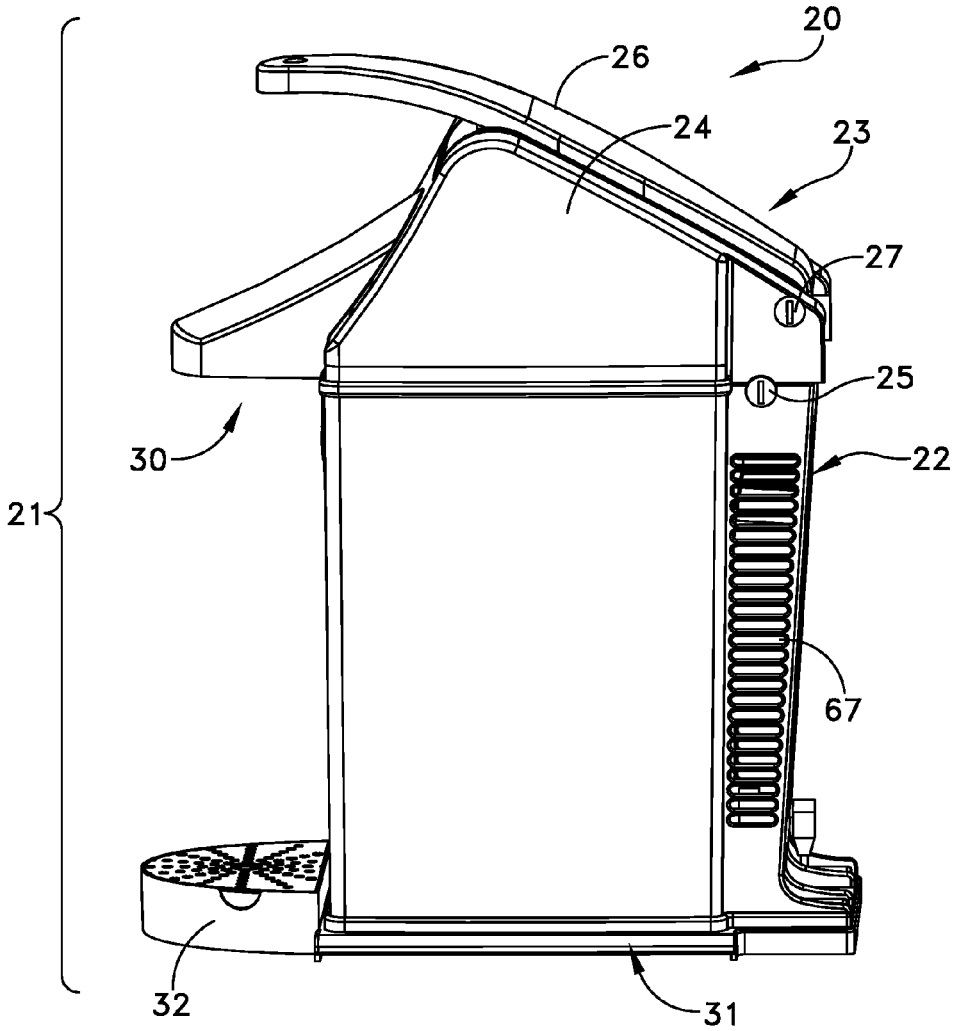
FIG. 2 is a perspective view taken from the right side of the dispenser shown in FIG. 1.
Figure 3:
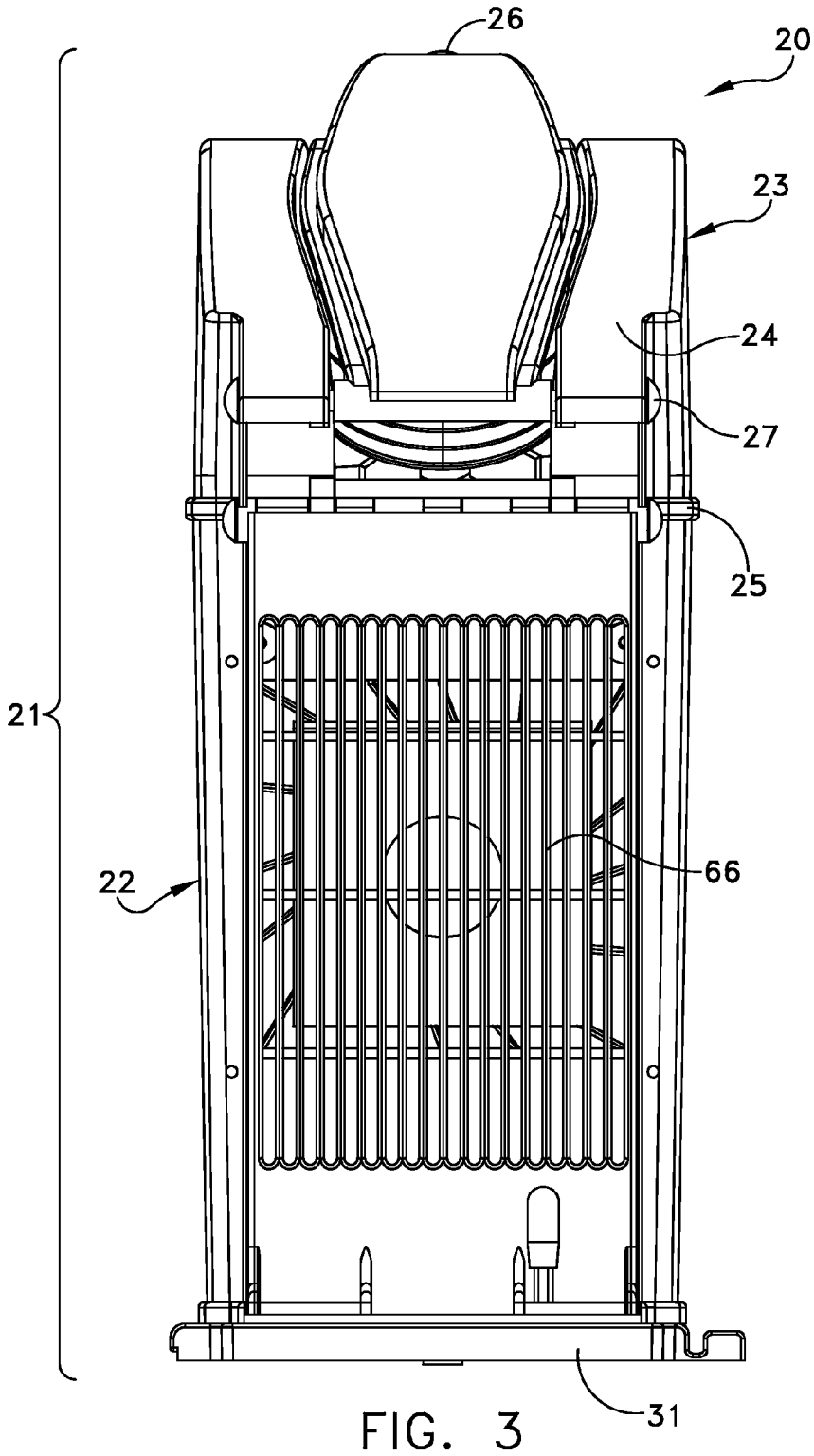
FIG. 3 is a rear view of the dispenser shown in FIG. 1.

FIGS. 1 through 3 depict a beverage dispenser 20 that refrigerates a packaged beverage and facilitates the dispensing of that beverage. In one specific application, the beverage dispenser 20 may include a container or carton of milk for being dispensed into coffee or tea in a cup. It will become apparent that this invention can be implemented as a dispenser for a wide variety of liquids and containers, although its primary application will be for beverages.

The beverage dispenser 20 includes a covered refrigerated housing 21 that includes an outer housing 22 and cover 23. The cover 23 includes a cover body 24 that rotates about a cover body hinge 25. In addition, the cover body 24 supports an actuator 26 that rotates about an actuator hinge 27 attached to the cover body 24. Liquid exits the beverage dispenser 20 at a dispensing position 30.

Still referring to FIGS. 1 through 3, the beverage dispenser 20 includes a base unit 31 with a drip basin assembly 32. The base unit 31 supports housing 21. The drip basin assembly 32 collects any beverage that may be spilled accidentally during use. The beverage dispenser 20 also contains indicia 33 for identifying the nature of the contents as, for example, milk, cream and half-and-half.

Figure 4:
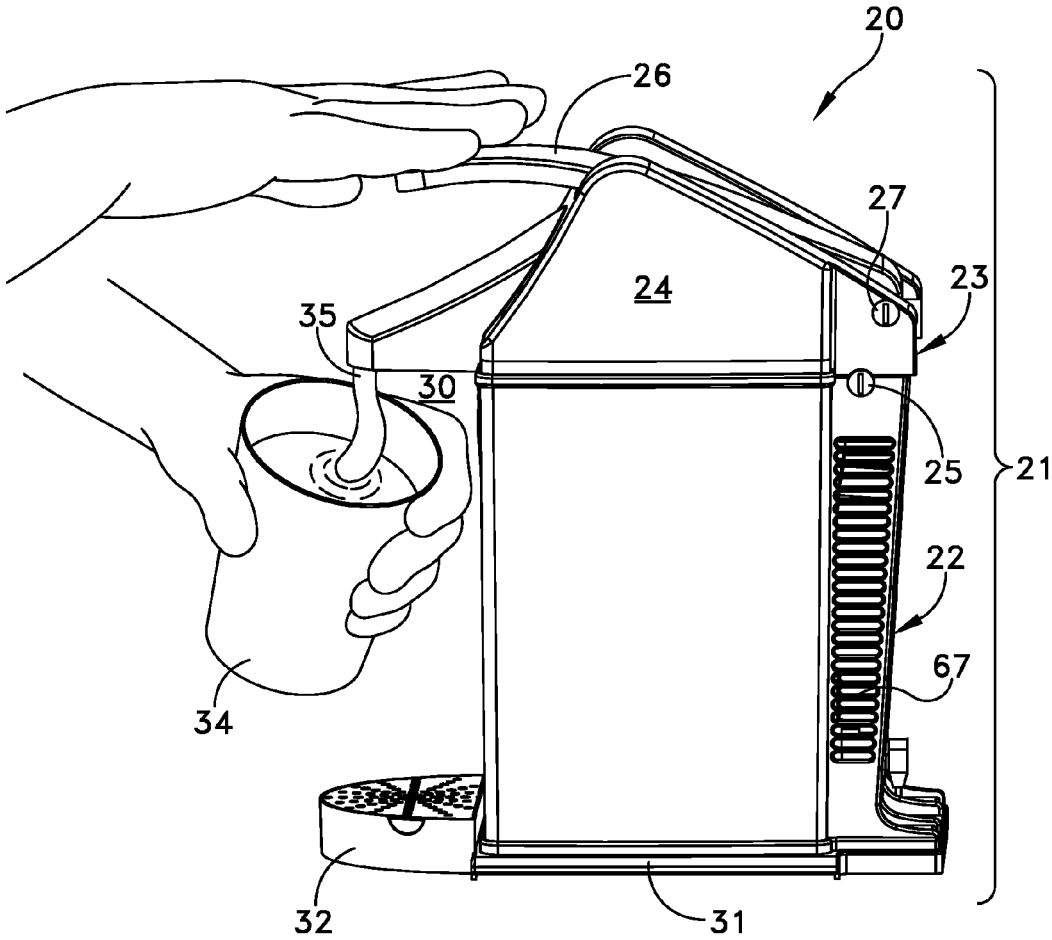
FIG. 4 is a view like FIG. 2 shown with a beverage being dispensed from the dispenser.

Referring now to FIG. 4, in use the consumer positions a cup 34 at the dispensing position 30. Then the consumer depresses the actuator 26 to dispense the liquid in a stream 35 into the cup 34. When the consumer depresses the actuator 26, the beverage dispenser produces a pressure differential that forces the chilled liquid from a container to be dispensed at the dispensing position 30. The beverage dispenser 20 comprises a number of the major assemblies to achieve this operation. These assemblies include the covered refrigerated housing 21 with subassemblies including the outer housing 22 and cover 23, a dispensing assembly that conveys the liquid from its container to the dispensing position 30, and a pressure differential enabling assembly that includes the actuator 26. When the consumer releases the actuator 26 after having dispensed a desired amount, the actuator 26 returns to the position shown in FIGS. 1 through 3. This terminates the flow of liquid as described hereinafter. Each of the foregoing assemblies will now be discussed in detail.

Covered Refrigerated Housing 21

Figure 5:
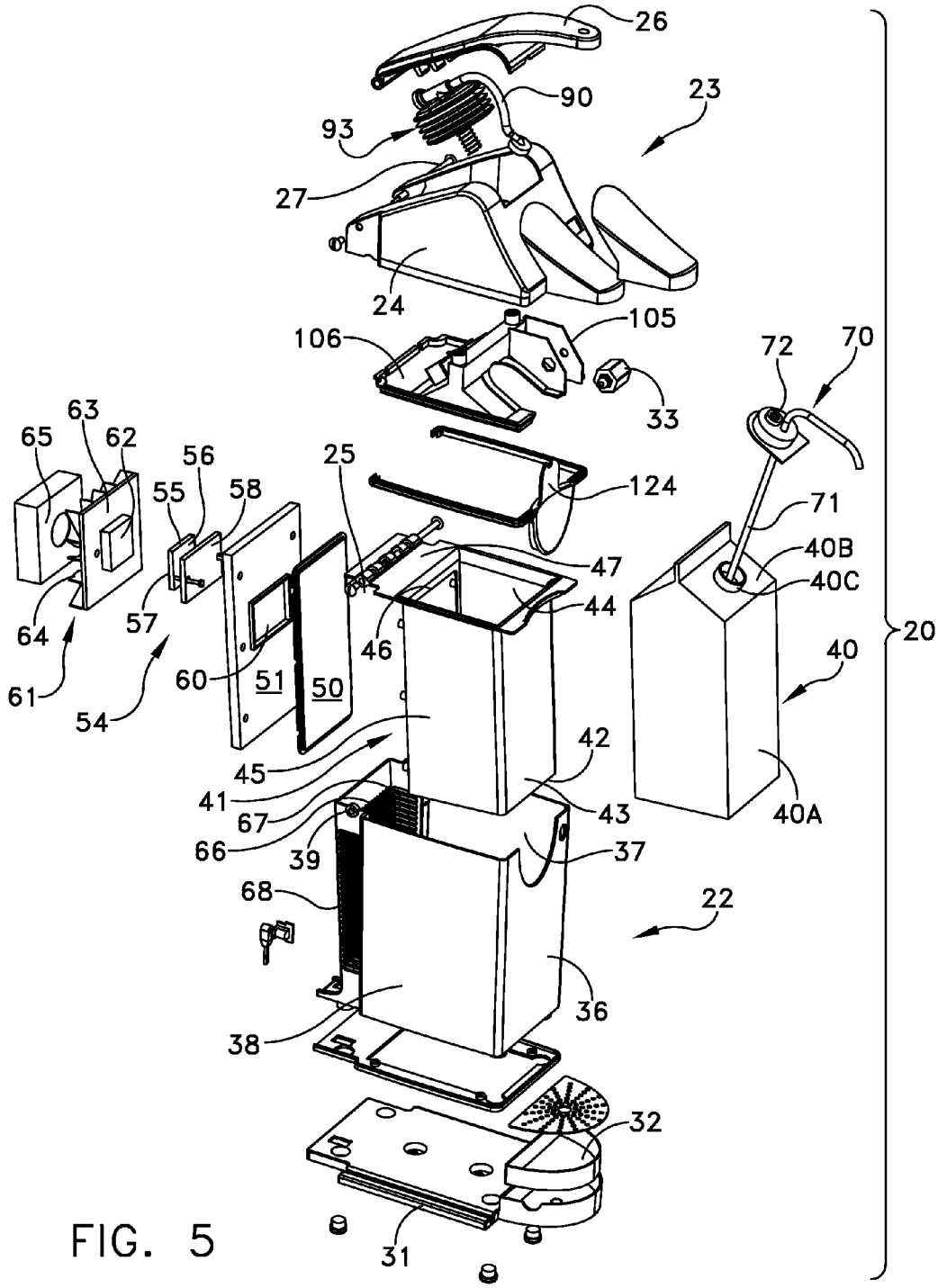
FIG. 5 is an exploded view of the dispenser shown in FIG. 1.
Figure 6:
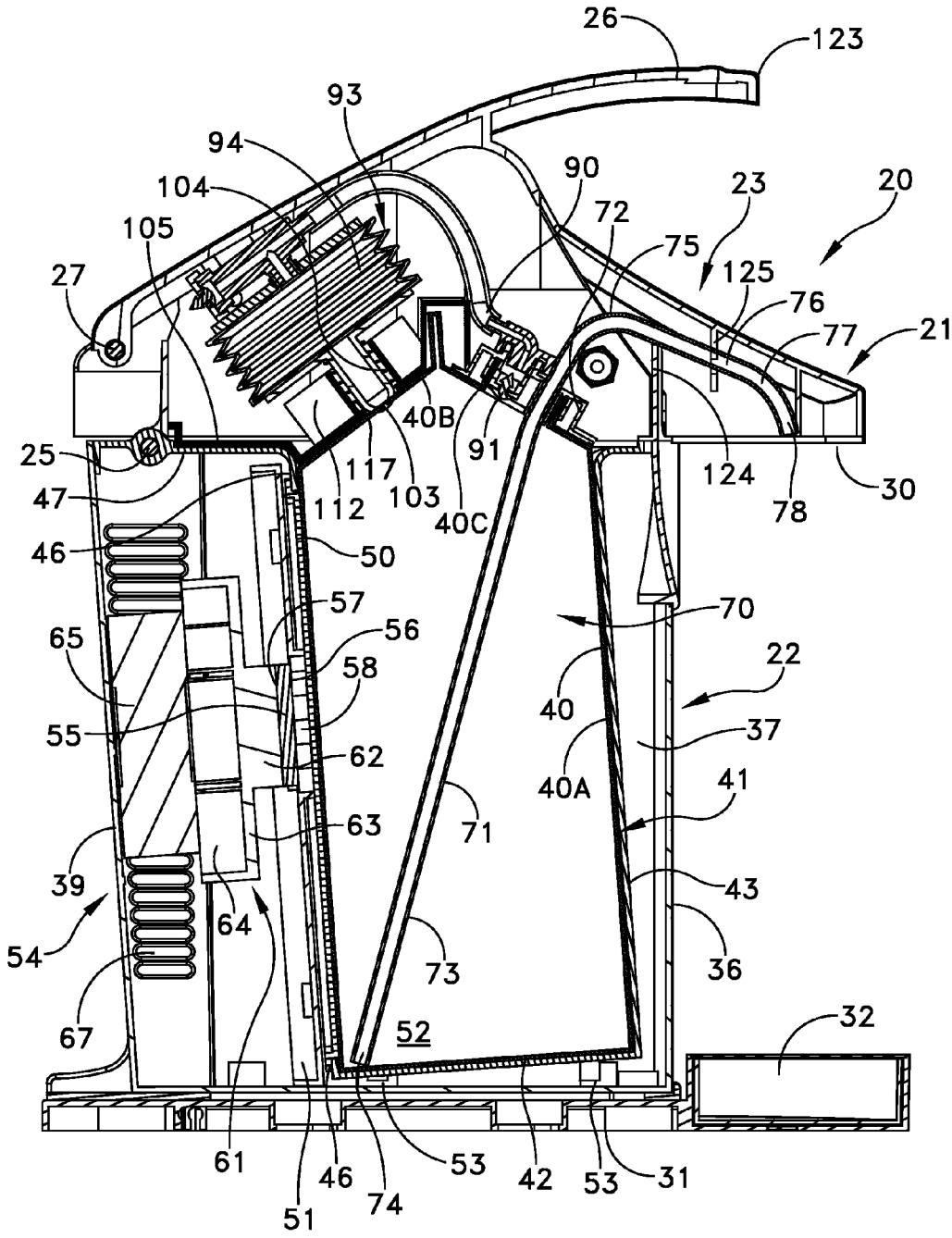
FIG. 6 is a cross sectional view taken along lines 5-5 in FIG. 1.

Referring now to FIGS. 5 and 6, the covered refrigerator housing 21 receives a liquid container and maintains the liquid at a predetermined temperature. In this specific embodiment, the outer housing 22 includes a front wall 36, a right side wall 37, a left side wall 38 and a rear wall 39 that spans the right and left side walls 37 and 38.

This outer housing 22 supports a holder for a liquid container, such as a milk or cream carton 40, by means of an inner sleeve 41 with a bottom 42, a front wall 43, and right and left side walls 44 and 45. A rear frame 46 includes a top extension 47 that carries the hinge 25 for the cover 23. A thermally conducting plate 50 formed, for example, of aluminum mounts to a rear wall 51 to span and closes the back of the sleeve 41. Collectively, the elements 41 through 50 form a closed bottom inner sleeve that receives a liquid container, namely the carton 40 in the embodiment shown in FIGS. 5 and 6.

As will be apparent, in any specific implementation the sleeve 41 will be sized and configured to conform to a specific carton 40. In this embodiment, the carton 40 is a half-gallon carton and has a square bottom section 40A and roof-shaped top 40B with a spout 40C, normally closed by a cap that is not shown. In addition, the sleeve 41 may be canted, as shown in FIG. 6 to lie along an axis that slopes from a forward position at the bottom to a rearward position at the top. Canting assures that the carton 40 forms a low area 52 that enables essentially all the liquid in the carton 40 to be dispensed. A portion of the weight of the carton, and its contents, will act to produce intimate contact between one wall of the carton 40 and the cold plate 50 to maximize heat transfer efficiency. Feet or supports 53 (FIG. 6) of different heights provide one means for canting the sleeve 41.

Still referring to FIGS. 5 and 6, the cold plate 50 constitutes one element of a heat exchanger 54 that, in this embodiment includes a thermoelectric refrigeration unit located intermediate the outer housing 22 and the inner sleeve 41. The heat exchanger 54 maintains the contents of the carton 40 at a predetermined temperature that preserves the freshness of the liquid. More specifically, an electrically powered Peltier thermoelectric refrigeration unit 55 has a cold side 56 and a hot side 57. The cold side 56 mounts to a block 58 that extends through an access window 60 in the back wall 51 to contact the cold plate 50.

An air cooled heat sink 61 includes a body portion 62 that extends from a mounting plate 63 for a set of radial fins 64 to the hot side 57 of the Peltier unit 55. A fan 65, shown in FIG. 6, establishes air flow from the exterior of the dispenser 20 through a back grate 66 and across the radial fins 64 to exit through right and left side grates 67 and 68.

As will now be apparent, when the Peltier thermoelectric refrigeration unit 55 is energized by an electric power supply, not shown but well known to those skilled in the art, heat transfers from the liquid in the carton 40 through the cold plate 50 and mounting block 58 into the semiconductor that constitutes current passing through the semiconductor converts the thermal energy into a flow of electrons which are converted back into thermal energy on the "hot" face 57 of the semiconductor. The fan 65 blows ambient air across the heat sink comprising the radial fins 64 to absorbing the thermal energy thereby completing the heat exchange process. As will also be apparent, the dispenser 20 may also include temperature sensors and circuitry for controlling the energization of the Peltier thermoelectric refrigeration unit 55 to maintain the liquid in the carton 40 at a predetermined temperature.

Dispensing Assembly

Figure 7:
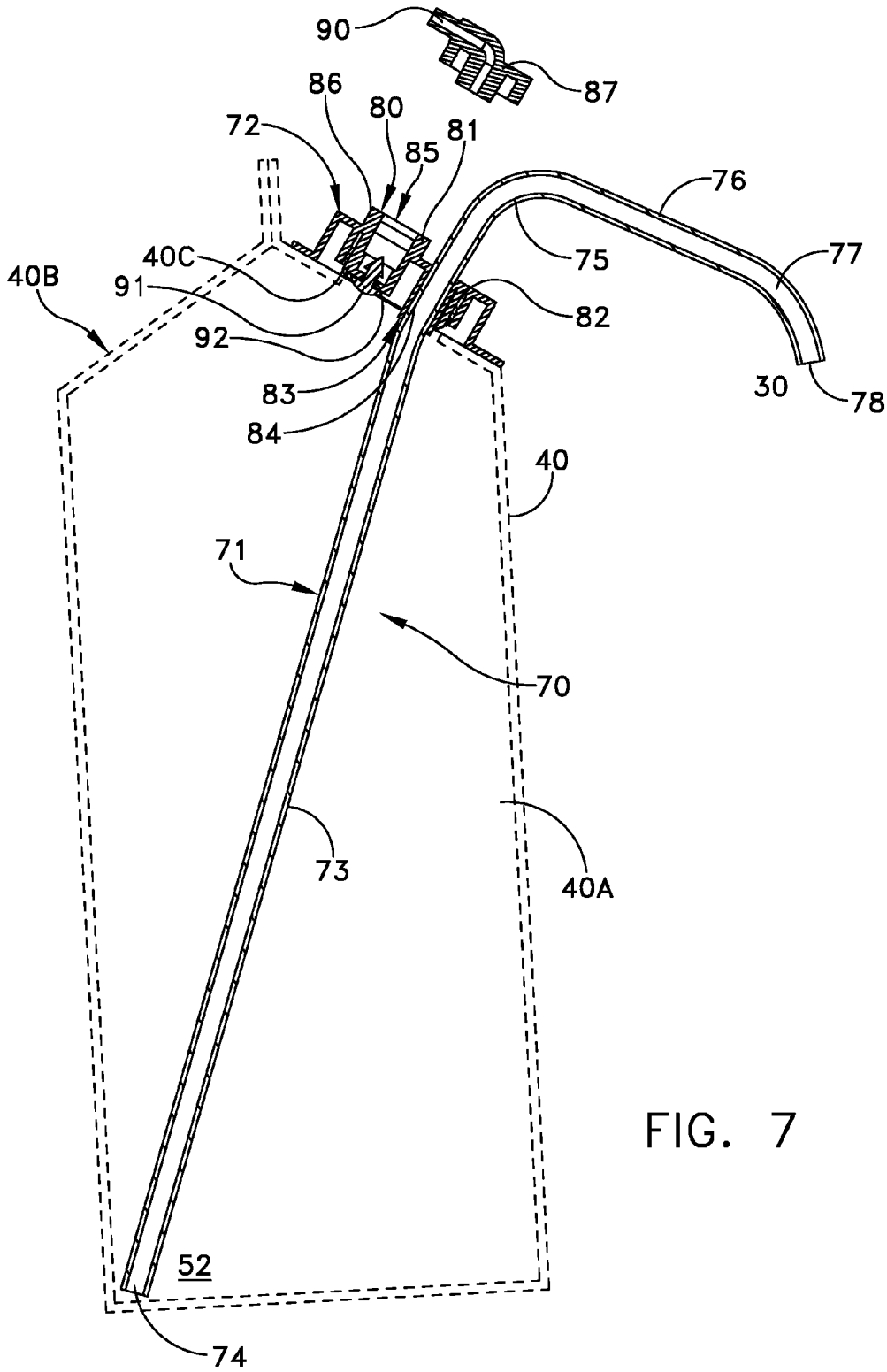
FIG. 7 is a cross section of a disposable dispensing assembly that is included in the beverage dispenser of FIG. 1.
Figure 7A:
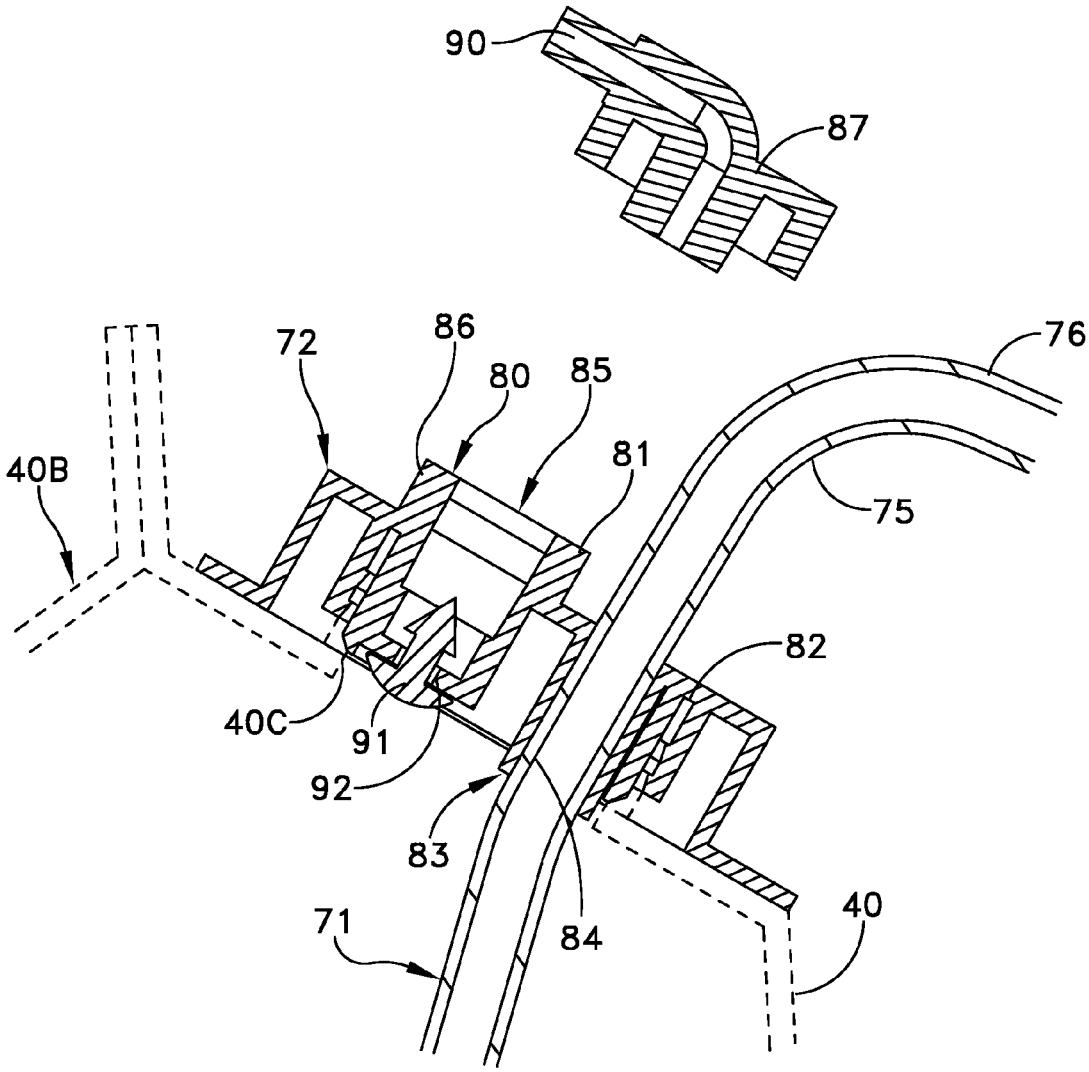
FIG. 7A is an enlarged cross section of a portion of the assembly shown in FIG. 7.

As previously indicated, the beverage dispenser 20 includes a dispensing assembly 70 that directs liquid from the carton 40 to the dispensing position 30. As shown in FIGS. 5 through 7, a preferred embodiment of the dispensing assembly 70 comprises an integrally formed dispensing tube 71 and cap 72 that is particularly appropriate for reducing maintenance and cleaning costs.

Referring to FIGS. 6 and 7, the dispensing tube 71 has an inverted J-shape and includes a main leg portion 73 with an inlet 74 at one end. The dispensing tube 71 extends from other end of the main leg portion 73 through a radiused portion 75, a lateral extension 76 and a curved output section 77 positioned by the beverage dispenser 20 to end at a dispensing outlet 78.

The cap 72 is formed as a generally cylindrical fitting 80 having a body 81 with an annular groove 82. This construction enables the fitting to be snapped or otherwise attached to the spout 40C (shown in phantom in FIG. 7). The cap 72 has a first port 83 through which the dispensing tube assembly 70 extends. The dispensing tube assembly 70 is sealed to the cap 72 at the first port 83. This structure then provides a closed path from the interior of the carton 40 to the dispensing outlet 78 through the first port 83, specifically a passage 84.

A second port 85 provides a passage through the cap 72 whereby pressure can be applied to the interior of the carton 40. In this specific embodiment, the second port 85 includes a male input fitting 86 for receiving a female fitting 87 attached to one end of an air pump hose 90. The passage through the second port 85 includes a one-way valve 91 that can close passages 92. When pressure is applied through the tubing 90, the valve 91 opens. When the pressure on the liquid in the carton 40 exceeds the pressure in the tubing 90, the valve 91 closes and blocks any transfer of air or entrained liquid from entering the tubing 90 through the passages 92.

Pressure Differential Enabling Assembly

Figure 8:
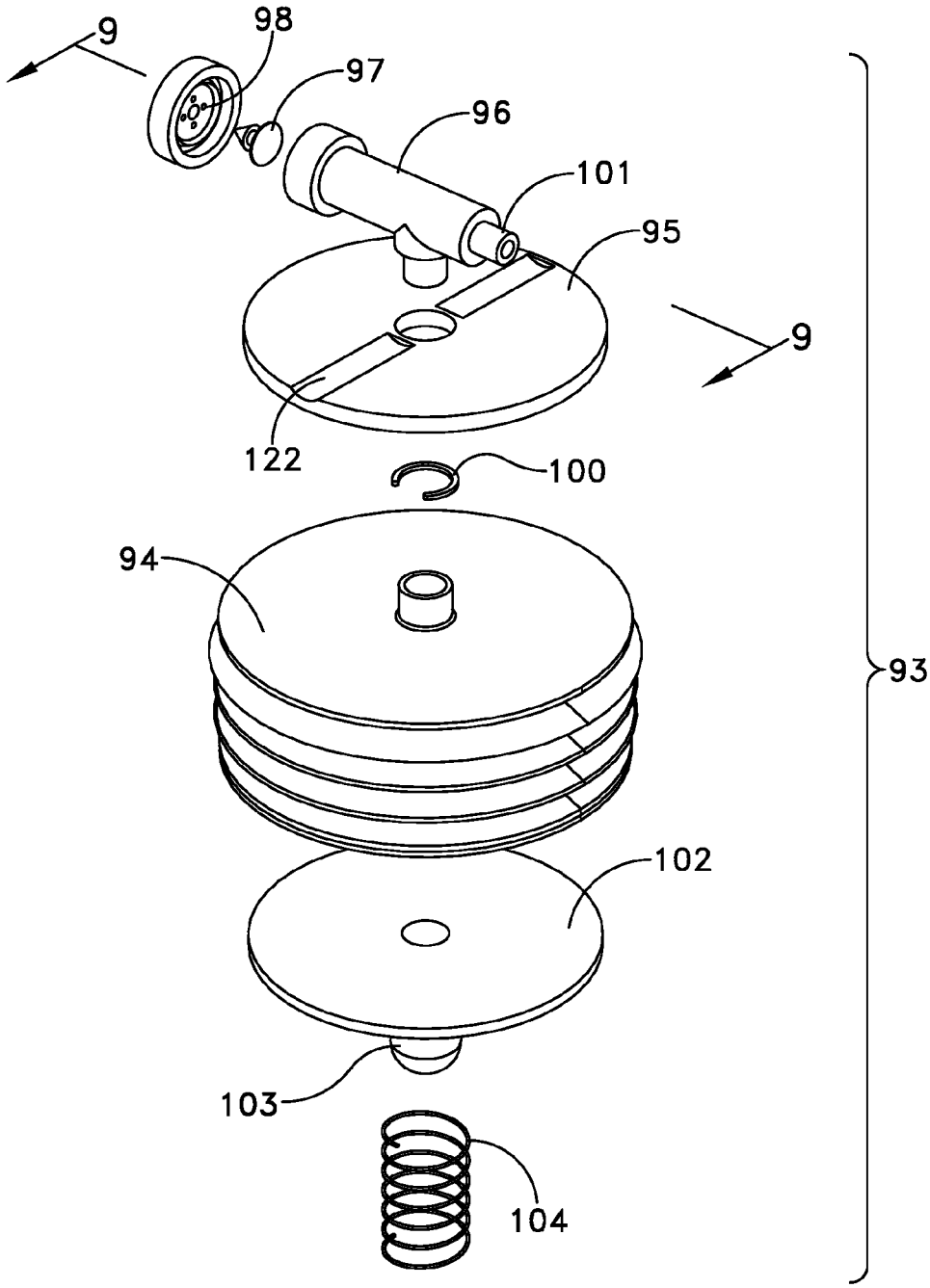
FIG. 8 is an exploded view of a bellows pump that is included in the beverage dispenser of FIG. 1.
Figure 9:
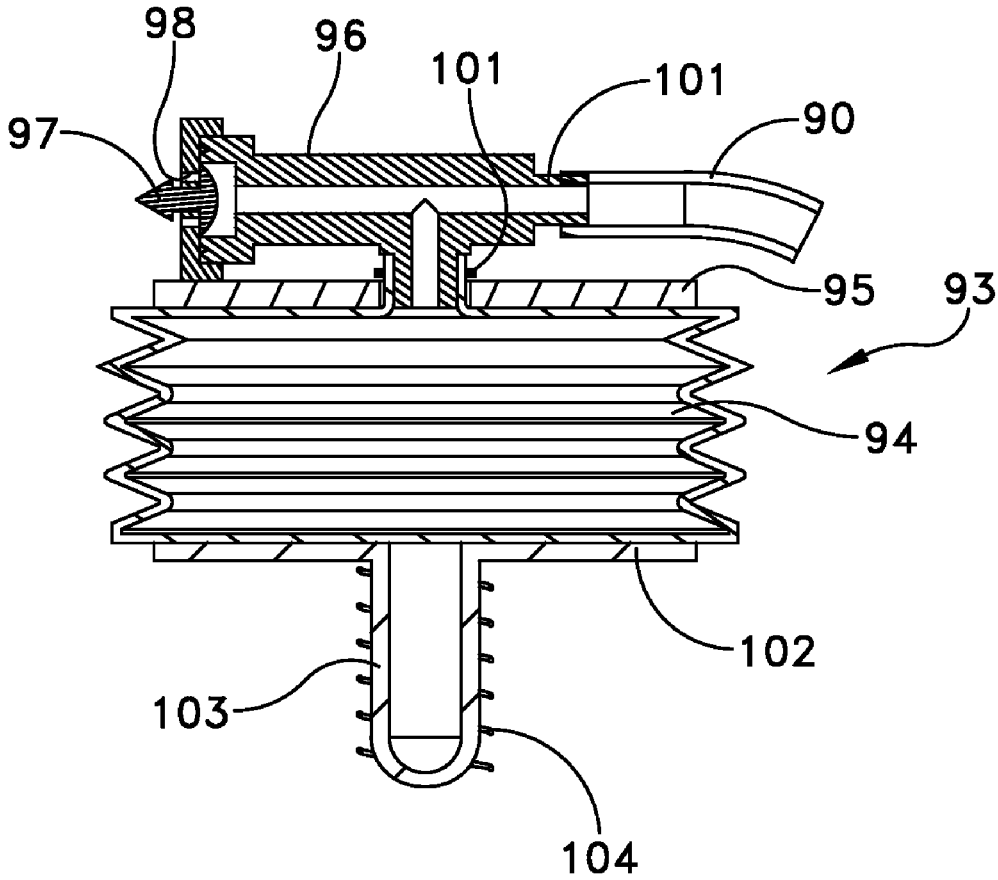
FIG. 9 is a cross sectional view of the bellows pump taken along lines 9-9 of FIG. 8.

Referring to FIGS. 5 and 6, in this embodiment a manually operated air pump 93 increases the air pressure in the carton 40 to dispense a portion of the contents at the dispensing position 30. The air pump 93 is a bellows pump disclosed in detail in FIGS. 8 and 9. A bellows 94 attaches to a top plate 95 and a valve body 96. The valve body 96, at one end, carries a one-way valve 97 that controls air flow through air passages 98. A C-ring 100, or other equivalent fastening device, connects the valve body 96 and bellows 94 together. At the other end, the valve body 96 forms a connector 101 for the air hose 90.

The bellows 94 is sandwiched between the top plate 95 and a bottom plate 102 that includes an axial extension 103. A spring 104 surrounds the axial extension. As will be apparent, compressing the bellows 94 increases the internal pressure so the valve 97 closes. Air is pumped through the hose 90 and into the carton 40 shown in FIGS. 5 and 6. When the bellows 94 expands, the valve 97 opens and admits air into the bellows 94.

As shown in FIGS. 5 and 6, the cover 23 carries the air pump 93. More specifically, an internal lid 105 spans the bottom of the cover body 24. As shown in more detail in FIGS. 10 and 11, the internal lid has a flat portion 106 that overlies the top extension 47 in FIG. 5. A middle channel 107 lies at the apex of converging ramp portions 110 and 111. The ramp portions 110 and 111 produce a truncated triangular space below the internal lid 105 to conform to the roof 40B shown in FIG. 5.

Figure 10:
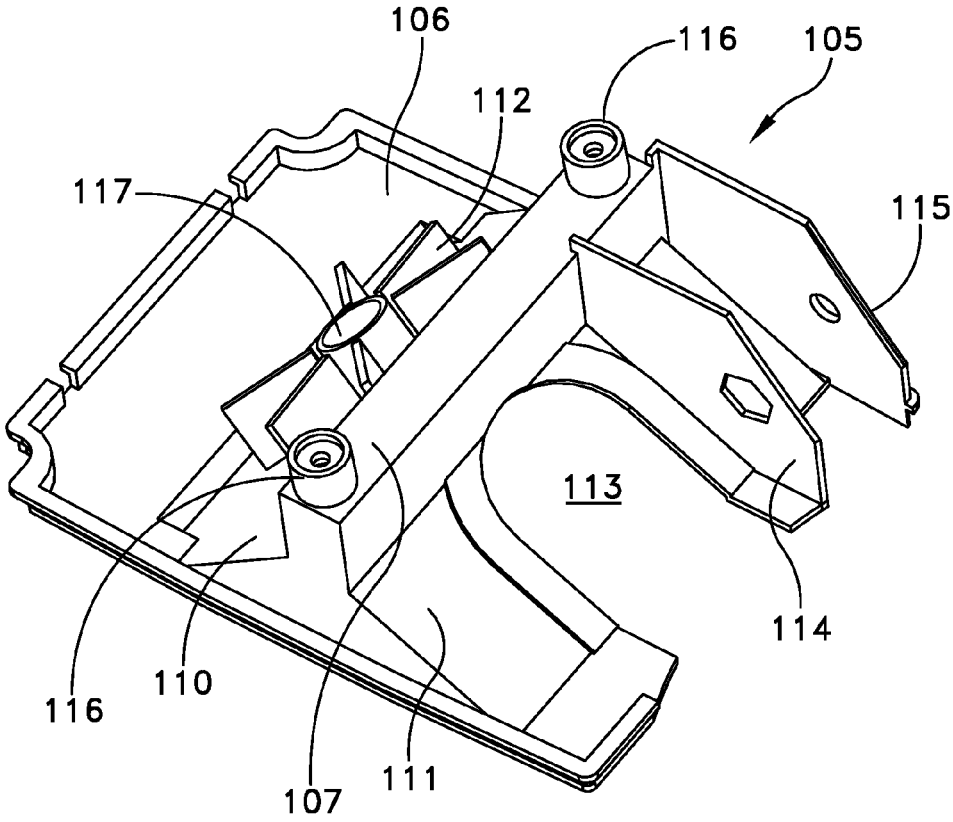
FIG. 10 is a detailed perspective view of an internal lid that is included in the beverage dispenser of FIG. 1.
Figure 11:
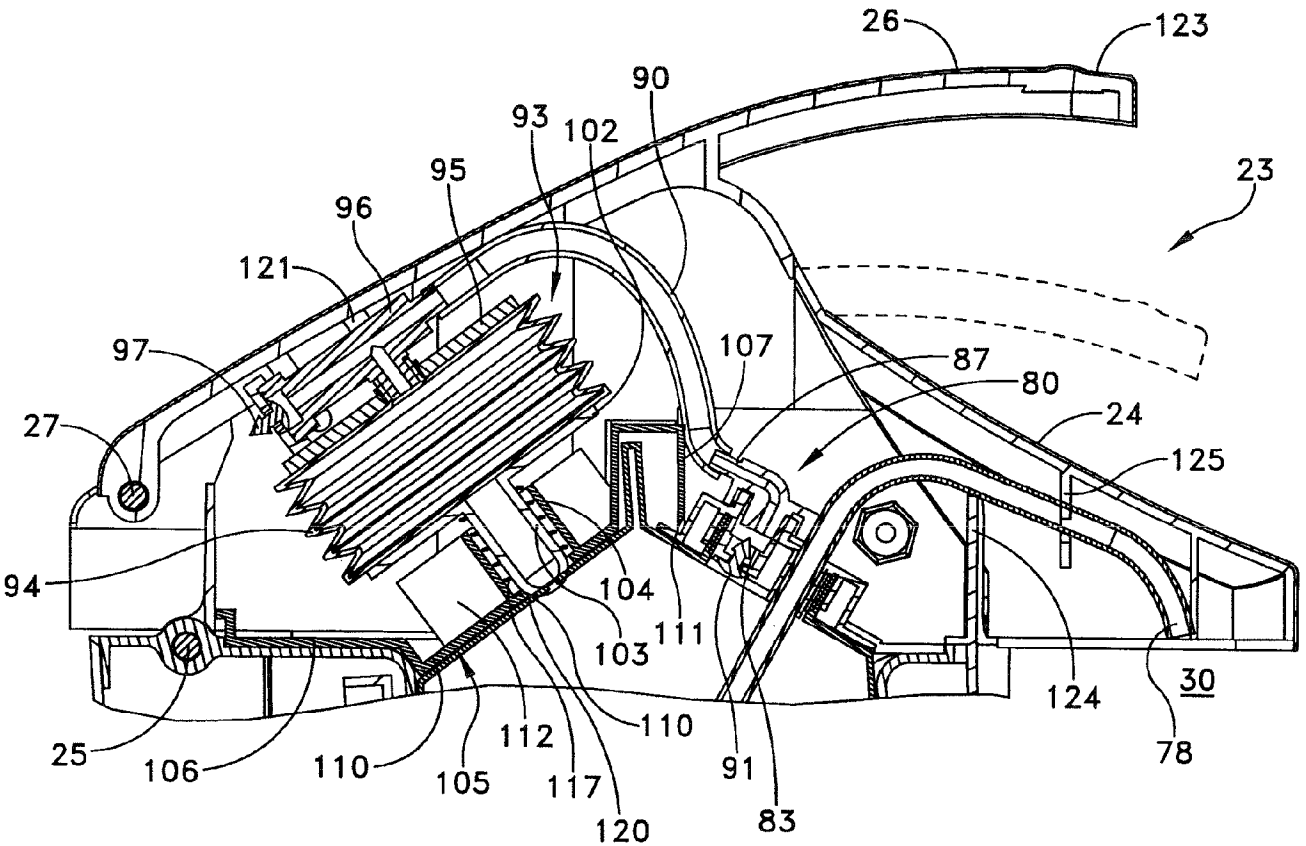
FIG. 11 is an enlarged cross section of a portion of the beverage dispenser in FIG. 1 showing the assembly of the bellows pump in the beverage dispenser.

Still referring to FIGS. 10 and 11, the ramp portion 110 includes a base 112 that supports the air pump 93. In this particular embodiment the base 112 comprises a plurality of radially extending ribs. It will be apparent, however, that the exact structure is not critical to performing the function of supporting the air pump 93.

The ramp portion 111 includes a central U-shaped cutout portion 113 and, to one side, parallel walls 114 and 115 that support the indicia 33 shown in FIG. 1. Mounts 116 provide a means for positioning and fastening the internal lid 105 to the cover body 24.

The base 112 includes a central passage 117. As shown most clearly in FIG. 11, the axial extension 103 and spring 104 lie in the passage 117 when the air pump 93 is in position. A collar portion 120 at the lower end of the passage 117 blocks any advance of the spring 104 while allowing the axial extension 103 to move in the passage 117 so that the air pump 93 floats in the base 112.

Operation of First Embodiment

Figure 12:
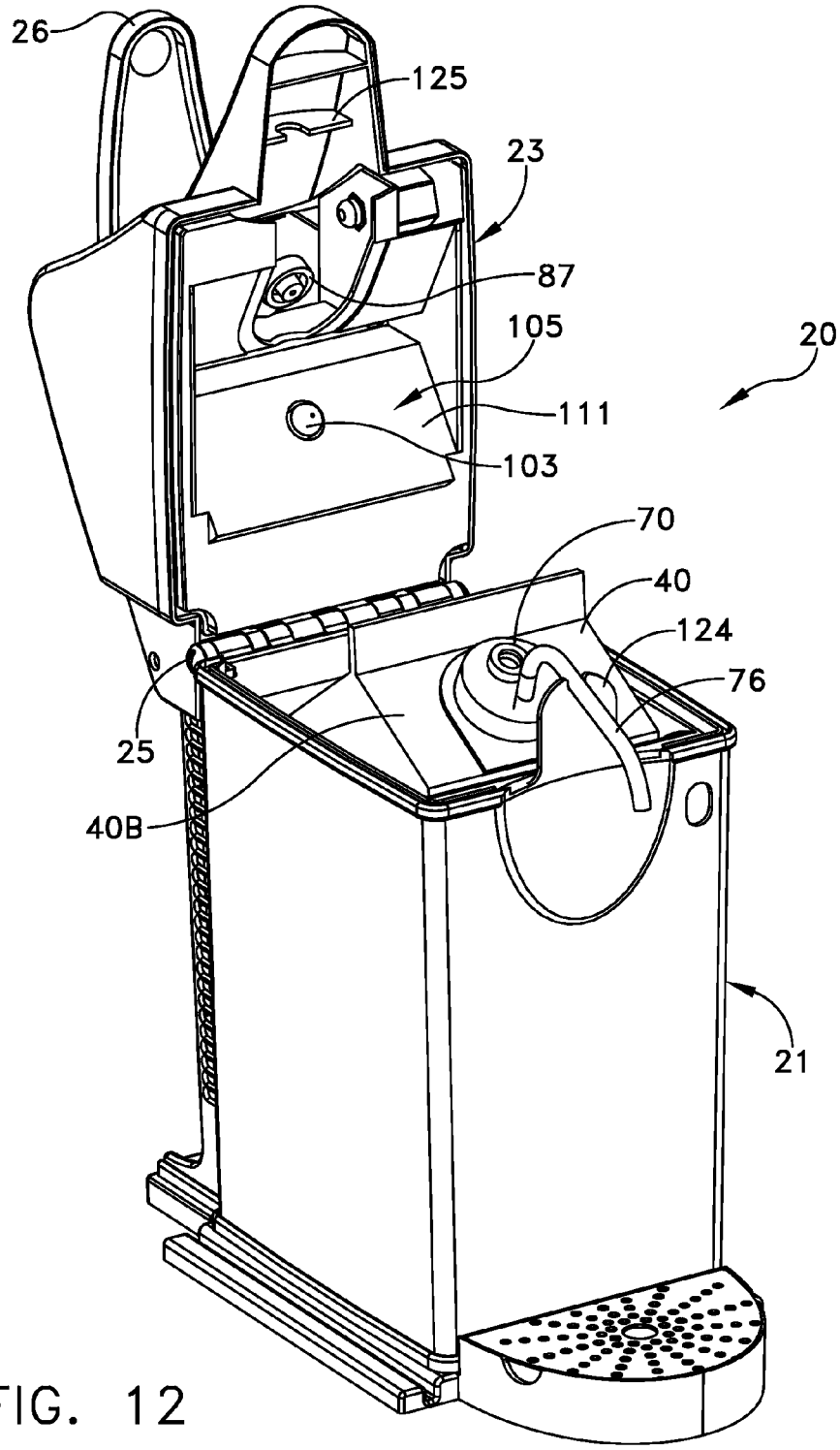
FIG. 12 is a perspective view of the beverage dispenser in FIG. 1 with the cover opened.
Figure 13:
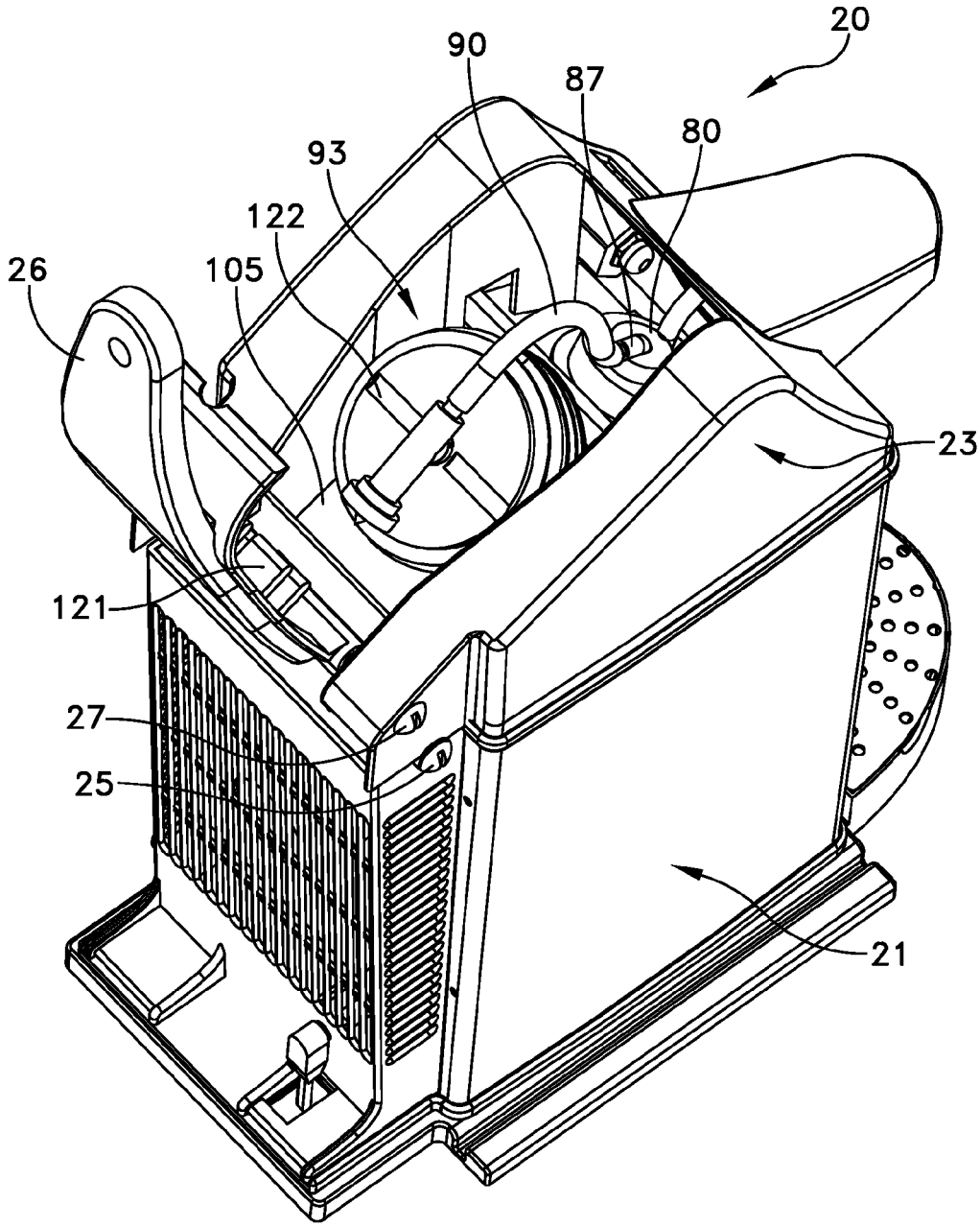
FIG. 13 is a perspective view of the beverage dispenser in FIG. 1 with the cover closed and an actuator retracted.

The operation of the beverage dispenser 20 can now be discussed with particular reference to FIGS. 11, 12 and 13. When it becomes necessary to exchange a carton, the cover 23 and actuator 26 rotate to a position shown in FIG. 12. This exposes the carton roof 40B and the disposable dispenser assembly 70. In addition, as shown in FIG. 12, when the cover 23 is rotated, the hose fitting 87 and the tip of the axial extension 103 are become readily accessible. Next the disposable dispenser assembly 70 is removed. Should the dispenser assembly 70 be reusable, it is cleaned. The old carton 40 is removed and a new, full carton is inserted. Any cap on the spout 40C is removed. The carton 40 then lies within the sleeve 41 and is canted to be in contact and abut the cold plate 50 shown in FIG. 6.

Next the dispenser assembly 70 is inserted through the spout 40C. The lateral extension 76 of the dispenser assembly 70 is positioned in a support 124 to provide lateral and vertical stability. Next the cover 23 is closed. This positions another rib or wall 125 to straddle the extension 76 as specifically shown. This further stabilizes the position of the extension 76.

Referring now particularly to FIG. 13, the actuator 26 remains in a retracted position when the cover 23 closes. Consequently there is access to allow the hose fitting 87 to be attached to the fitting 80 particularly to the second port 85 as shown in FIG. 11.

FIG. 13 also depicts fingers 121 and the depressions 122 in the air pump 93. After the air hose 90 is connected to the fitting 80, the actuator 26 is rotated clockwise as shown in FIG. 13 to the position shown in FIGS. 6 and 11 to bring the ends of the fingers 121 into contact with the depressions 122. This provides a link between the actuator 26 and the air pump 93. Then the beverage dispenser 20 is ready to use. At that point consumers can dispense beverages such as milk or cream from the dispenser 20 as previously described merely by depressing the actuator 26.

Referring to FIGS. 6 and 11, depressing an end 123 of the actuator 26, there is a compound motion of the bellows air pump 93. As a first component, the bellows 94 compresses to increase the internal air pressure on the surface of the liquid in the carton 40 through the first port 83. The second component is a translation motion of the air pump 93 relative to the body 112. This motion displaces the axial extension 103 to deform the carton roof 40B. The remainder of the carton 40 is constrained either by the nature of its construction or the sleeve 41. Consequently, this deformation reduces the internal volume of the carton 40 with a concomitant increase in pressure on the liquid.

At some point during the depression of the actuator 26, the air pressure on the liquid increases sufficiently to overcome any pressure drop in the dispensing tube 71 and the pressure difference that exists between the level of the liquid in the carton 40 and the dispensing outlet 78. When this occurs, liquid flows through the dispensing tube 71 to exit at the dispensing position 30.

Releasing the actuator 26 after dispensing a sufficient quantity of the liquid produces a reverse compound motion. The spring 104 drives the bellows air pump 93 away from the carton as one component of the motion. As a second component, the internal memory of the bellows material expands the bellows 94. This produces a rapid pressure drop on the liquid surface to stop the flow of liquid at the dispensing position 30. Initially the pressure drop produced by the expansion of the bellows will exceed the pressure drop produced by the expansion of the carton 40. This closes the valve 91 to block any entrained liquid from entering the air hose 90 and components of the air pump 03. Eventually the pressure on the liquid returns to atmospheric pressure whereupon the valve 91 opens.

The valve 91 also minimizes the risk of liquid entering the air hose 90 and air pump 93 should the dispenser 20 be tilted with a liquid containing carton 40 in place. Initial contact of any liquid with the fitting 80 will quickly close the valve 91. Some liquid might contact the fitting 80, but the amount of liquid passing the valve 91 before it closes will be insufficient to travel to the air pump 93.

As will now be apparent, the beverage dispenser 20 refrigerates a beverage or liquid and dispenses that beverage in a controlled manner. Cleaning operations are minimized. Moreover, as will be apparent the construction and assembly of the dispenser 20 minimizes costs thereby to make the beverage dispenser affordable for use in coffee shops and like businesses.

Second Embodiment

Figure 20:
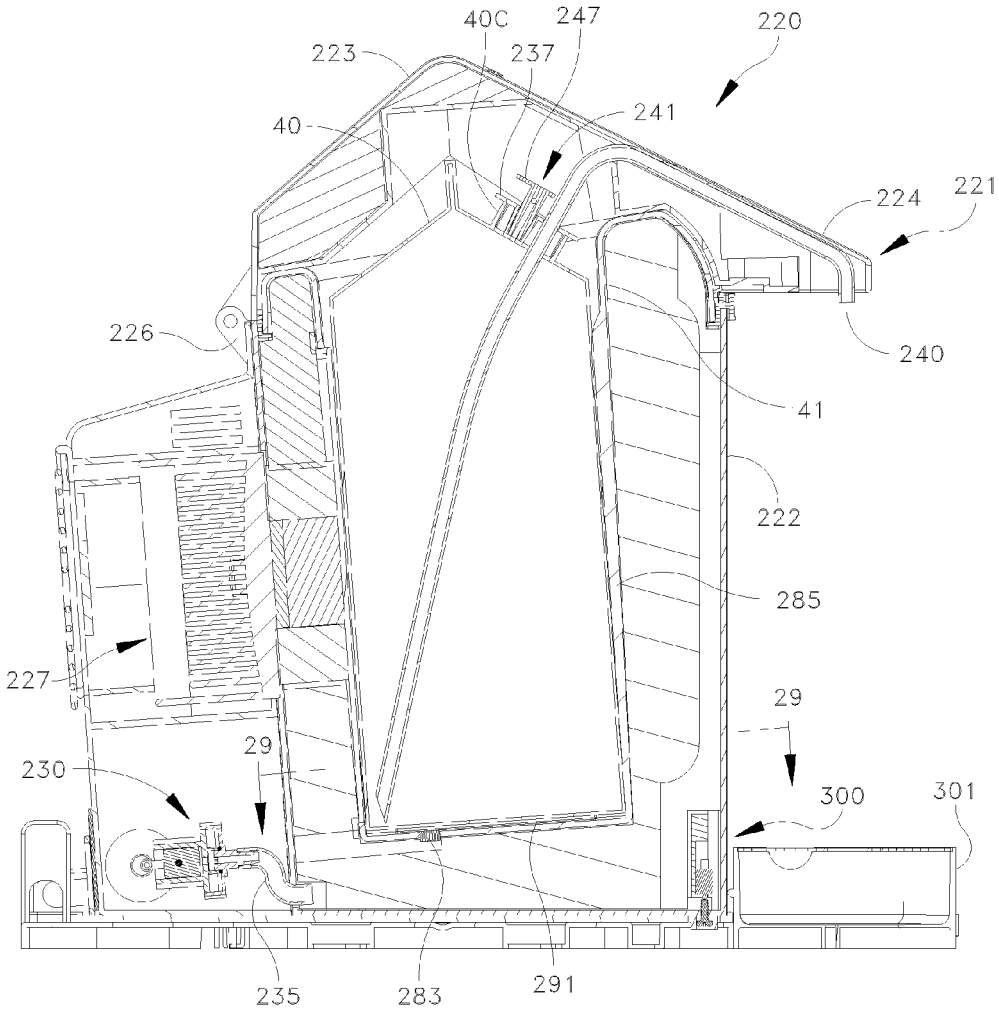
FIG. 20 is a sectional view taken along lines 20-20 in FIG. 18.
Figure 21:
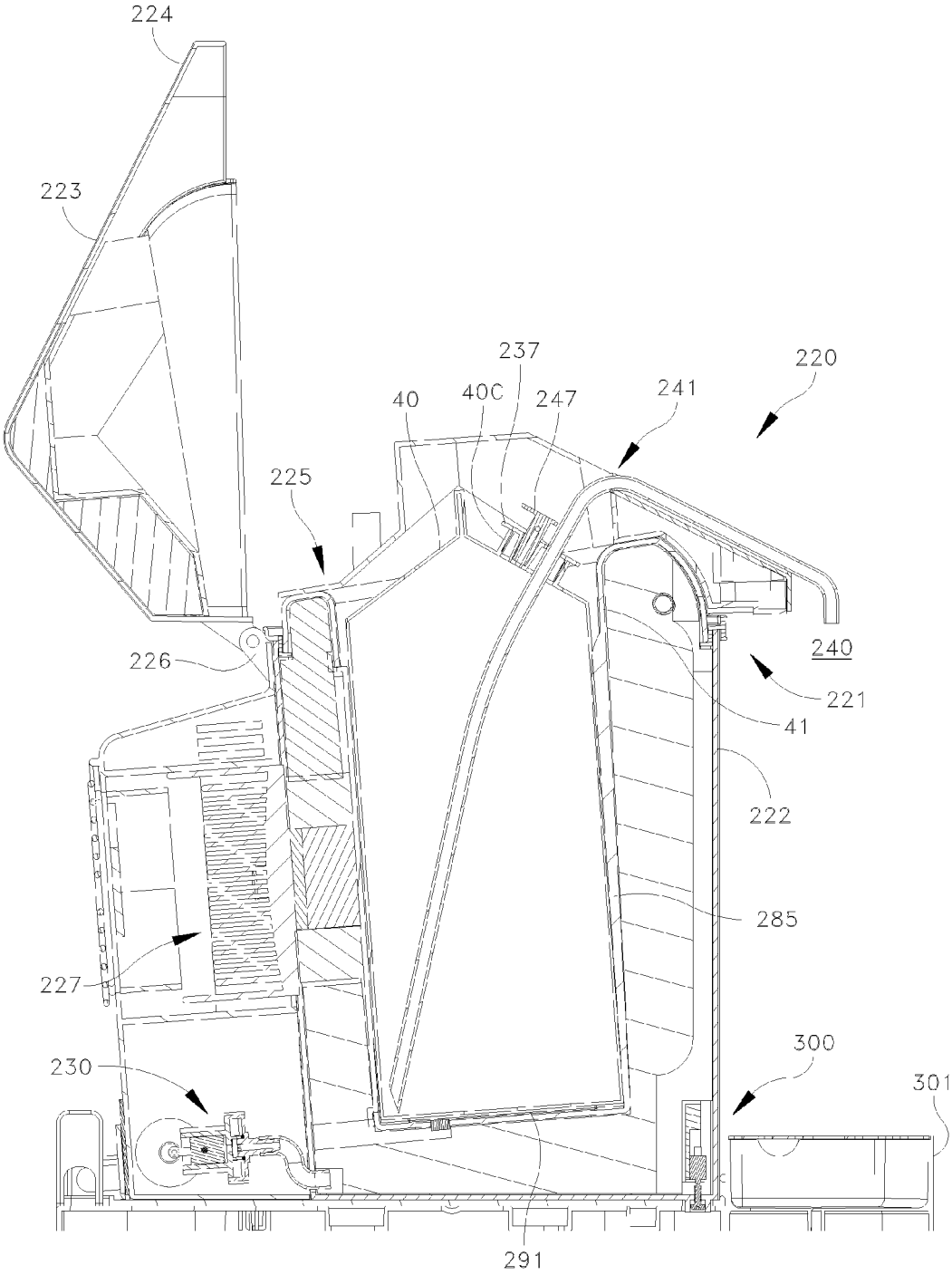
FIG. 21 is a sectional view taken along lines 20-20 of FIG. 19 with a cover in an open position.

FIGS. 18 through 27 collectively depict a second embodiment of an apparatus in the form of a beverage dispenser 220 for dispensing the contents of the liquid container in the form of a carton 40. As specifically shown in FIGS. 18 through 21, the beverage dispenser 220 includes a covered refrigerated housing 221 with an outer housing 222 and a cover 223 that includes an extension 224. In the first embodiment the cover carries various pumping apparatus; in this embodiment the cover 223 merely provides a closure over an open top 225 (FIG. 21) of the outer housing 222. The cover 223 pivots on hinges 226 from a closed position shown in FIG. 20 counterclockwise to an open position as shown in FIG. 21. This allows the carton 40 to be inserted in an inner canted sleeve 41 that lies against the cold side of a thermo-electric heat exchanger 227 such as the Pelletier-based heat exchanger 54A shown in the first embodiment. As a result, the heat exchanger chills any liquid in the carton 40.

Elements common to the first embodiment, such as the rear wall 39, are not described further with respect to the embodiments of FIGS. 18 through 27. Other elements found in the first embodiment may be rearranged, modified or omitted for reasons not associated with this invention. Such rearrangements, modification or omissions are not discussed because they are well within the knowledge of those of ordinary skill in the art.

Figure 22:
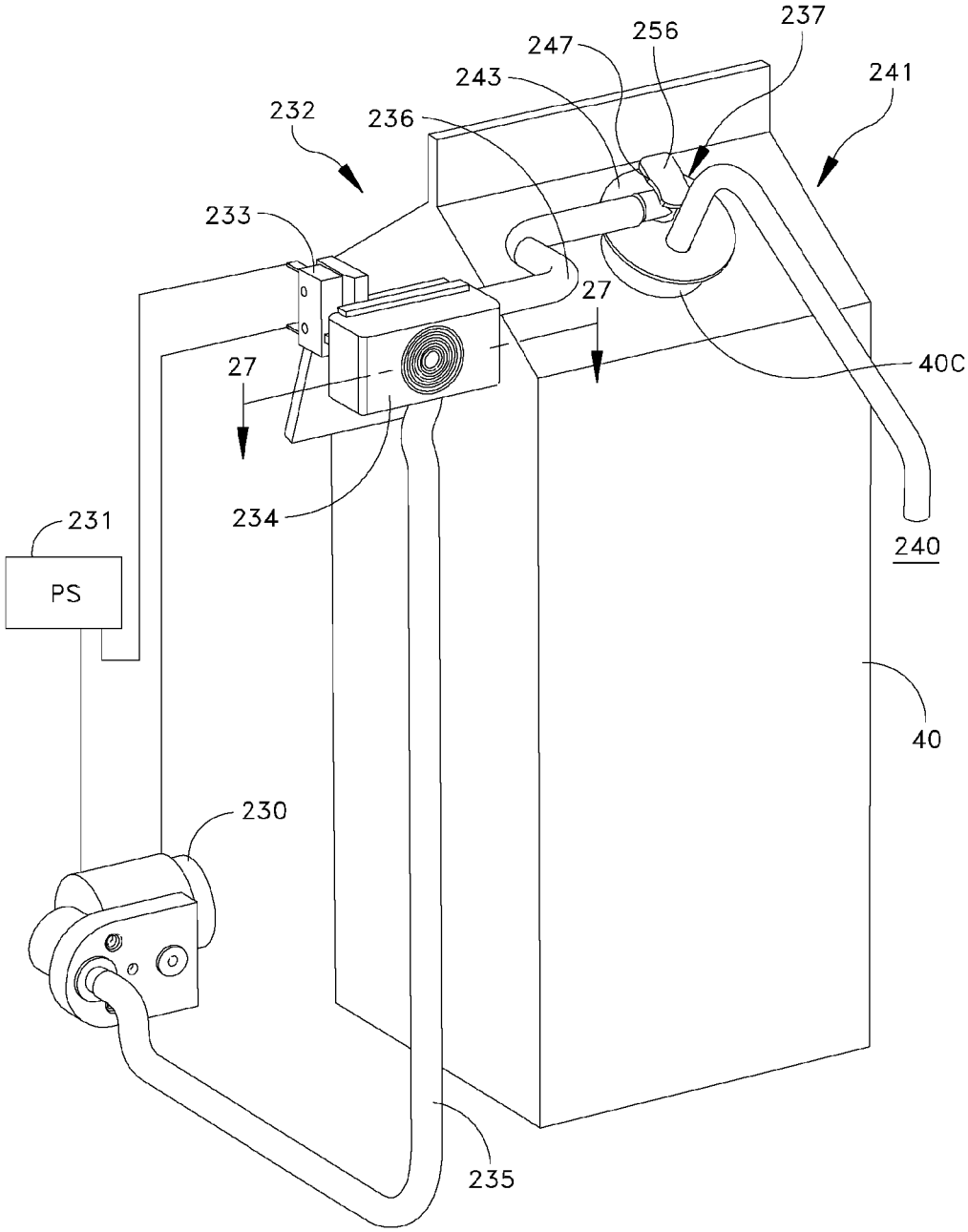
FIG. 22 is a simplified perspective view that depicts components of this invention.

The manually operated air pump and related apparatus in the first embodiment is eliminated. As shown particularly in FIGS. 20 through 22 a pressure generator includes an electrically operated, motor-driven air pump 230 and enables the development of a pressure differential between the atmosphere and the pressure acting on the liquid surface within the carton 40. Referring to FIG. 22, the air pump 230 connects to an internal or external power supply 231. An electro-mechanical controller 232 controls the pressurization of the liquid in the carton and includes an electrical switch, such as a normally open micro switch 233, that connects one side of the power supply 231 to the pump 230 in a known manner. That is, when the micro switch is in a normal state, it has an open contacts and the air pump 230 does not operate. However, depressing a mechanical control 234 closes the contacts in the micro switch 233. The power supply 231 energizes the air pump 230 providing air at increased pressures through an air passage in the form of a conduit or tubing 235 attached to the mechanical control 234 and another conduit or tubing 236 attached to a stopper 237.

Referring to FIG. 20, when the air pump 230 operates, the pressure inside the carton 40 increases. This increased pressure displaces the liquid in the carton through a dispensing assembly 241 to eject at a dispensing outlet 240.

There are two significant differences between the embodiment of FIGS. 1 through 17 and the embodiment of FIGS. 18 through 27. They involve the dispensing assembly 241 and the structure for enabling a pressure differential to exist between the surface of a liquid in the carton 40 and the dispensing outlet 240.

The dispensing assembly 241, as particularly shown in FIGS. 20 through 24, includes the stopper 237 that fits into the pouring spout 40C of the carton 40. The stopper 237 has a body 242 formed of an elastomer or like resilient material and an overlying top portion 243. The stopper body 242 seals against the interior of the pouring spout 40C. A first port 244 in the stopper 237 receives a J-shaped dispensing tube 245; a second port 246 receives a plug 247. The ports 244 and 246 define isolated passages through the stopper 242. When the stopper 242 is installed, it positions the inlet of the dispensing tube 245 at a low point in the carton 40.

Referring particularly to FIGS. 20 through 22, 25 and 26, the plug 247 has an L-shaped body 250 with an outlet passage 251 and inlet passage 252 formed in a vertical leg 253 and a horizontal leg 254, respectively. The horizontal leg 254 terminates in a fitting 255 that receives the tubing 236 shown in FIG. 22. In this embodiment the plug 247 is normally fixed to the tubing 236. Still referring to FIGS. 23 through 26, the vertical leg 253 is adapted to be inserted into the second port 246. A finger tab 256 at the top of the plug 247 facilitates the insertion and removal of the plug 246 from the stopper 237. Thus as air is pumped through the tubing 236, the inlet passage 252 and the outlet passage 251, into the sealed carton 40, the pressure bearing on the liquid in the container 40 increases and drives the liquid out of the carton 40 to be dispersed.

Figure 23:
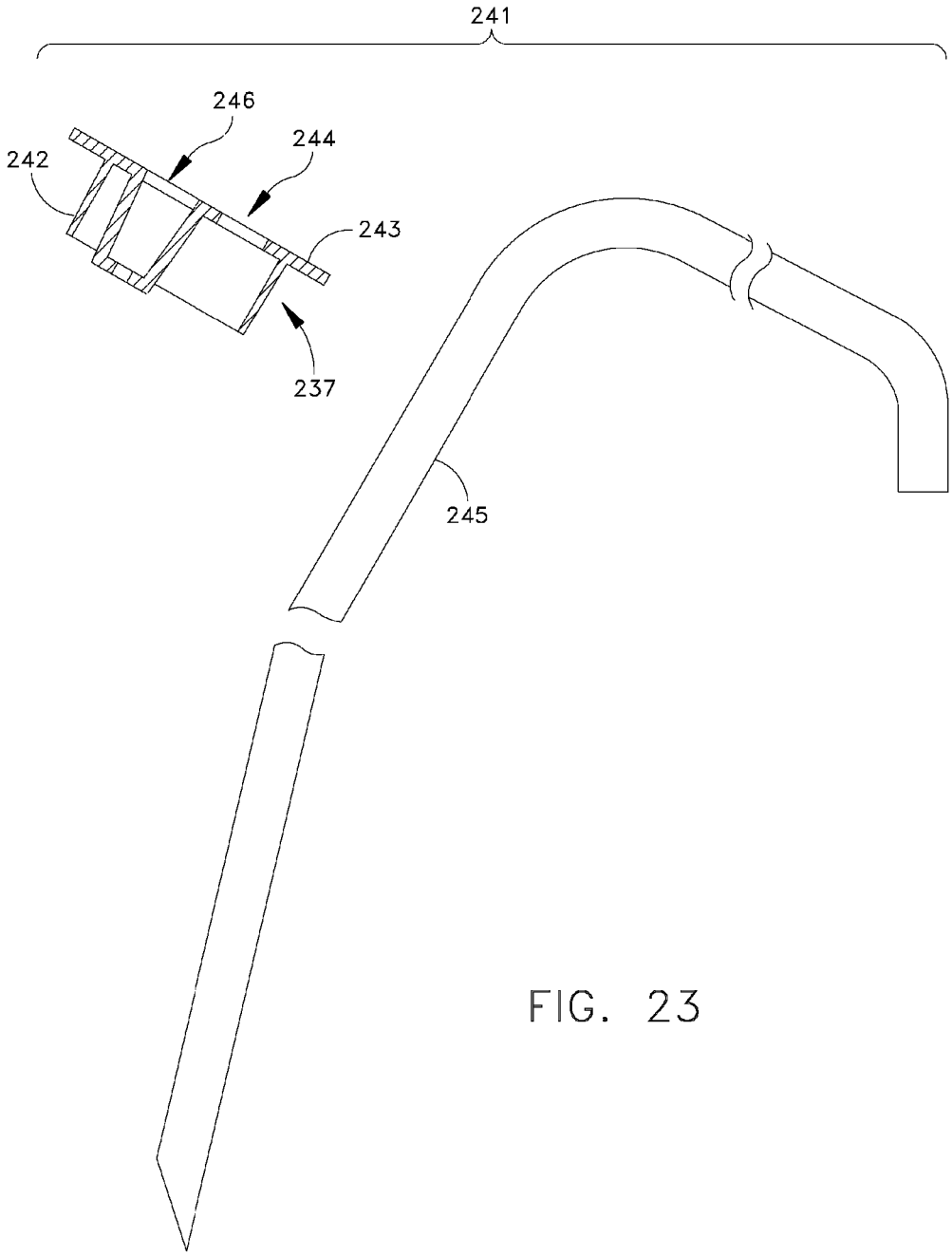
FIGS. 23 and 24 are views of a disposable dispensing assembly useful in this invention.
Figure 24:
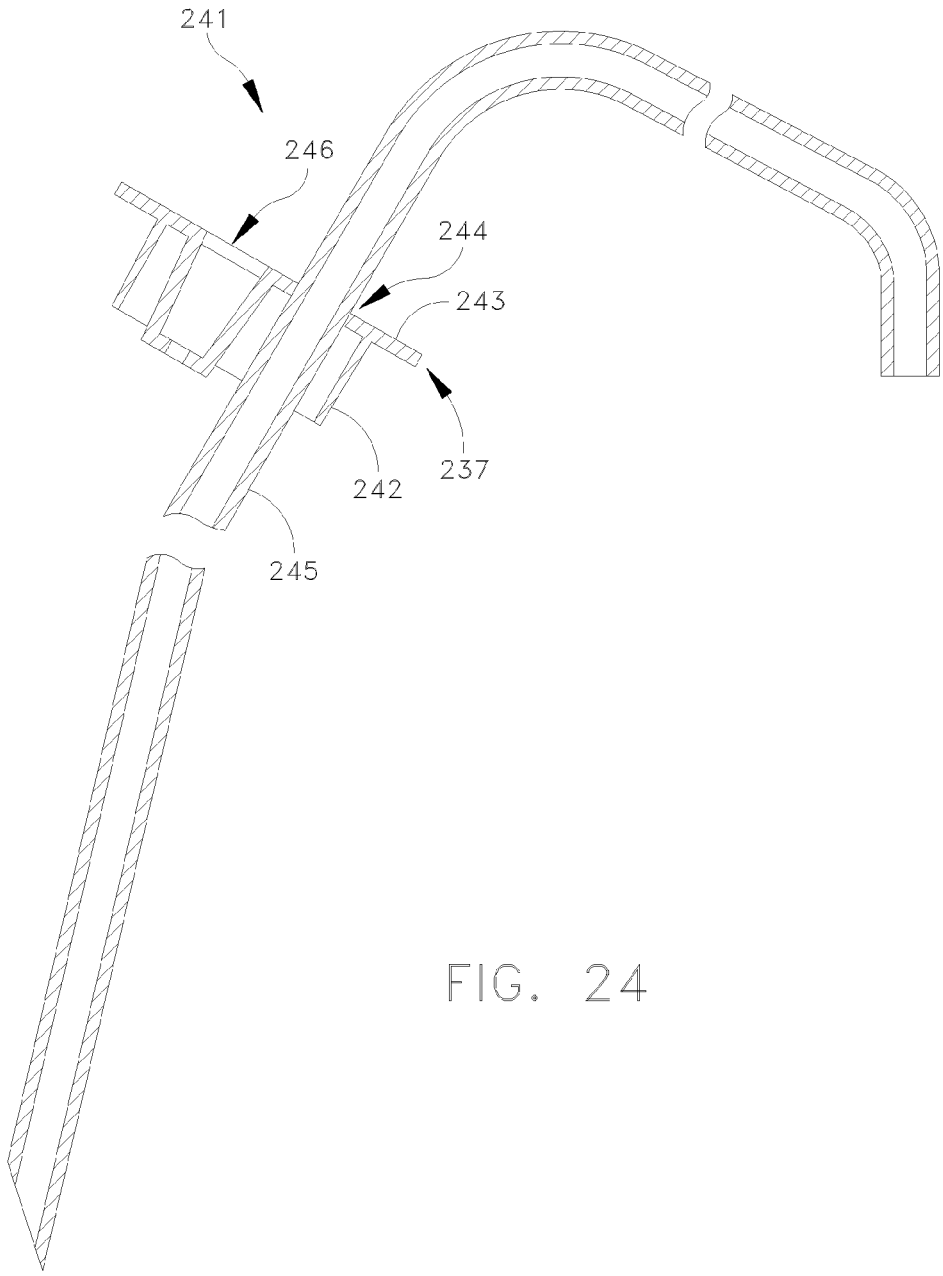
Figure 25:
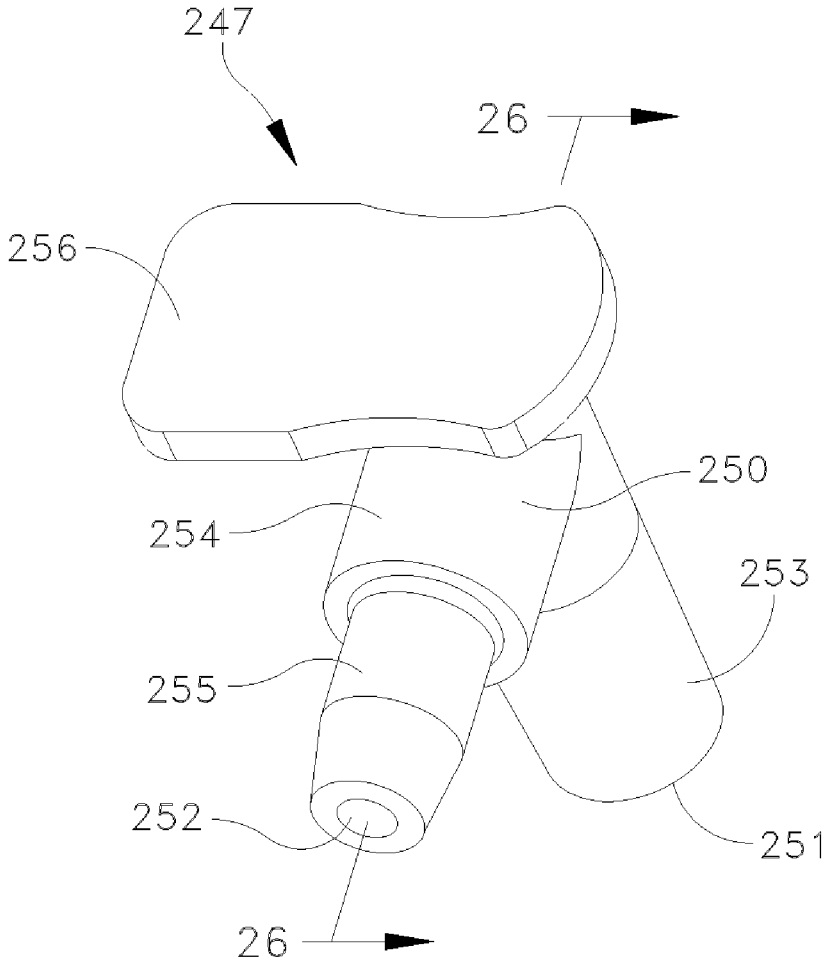
FIG. 25 is a perspective view of a plug shown in FIG. 21.
Figure 26:
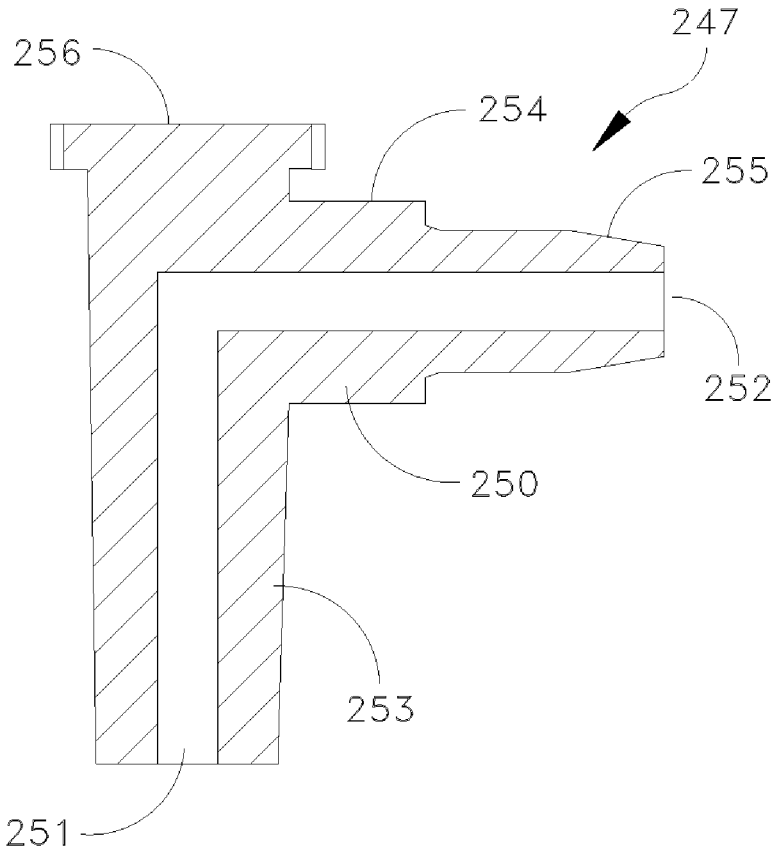
FIG. 26 is a sectional view taken along lines 26-26 in FIG. 25.

As will be apparent from FIGS. 22 through 24, the combination of the stopper 237 and the dispensing tube 245 constitute one embodiment of the disposable or removable dispensing assembly 241 that may be shipped as a preformed subassembly or as parts in a kit to be assembled on site. That is, a replacement dispensing assembly 241 could include the dispensing tube 245 and stopper 237 as discrete elements or as a subassembly. In another embodiment, it may be desirable for the plug 247 to constitute an additional component of the dispensing assembly 241. This feature allows the surfaces that contact the carton and liquid to be changed as a carton is replaced thereby to maximize sanitation.

Figure 27:
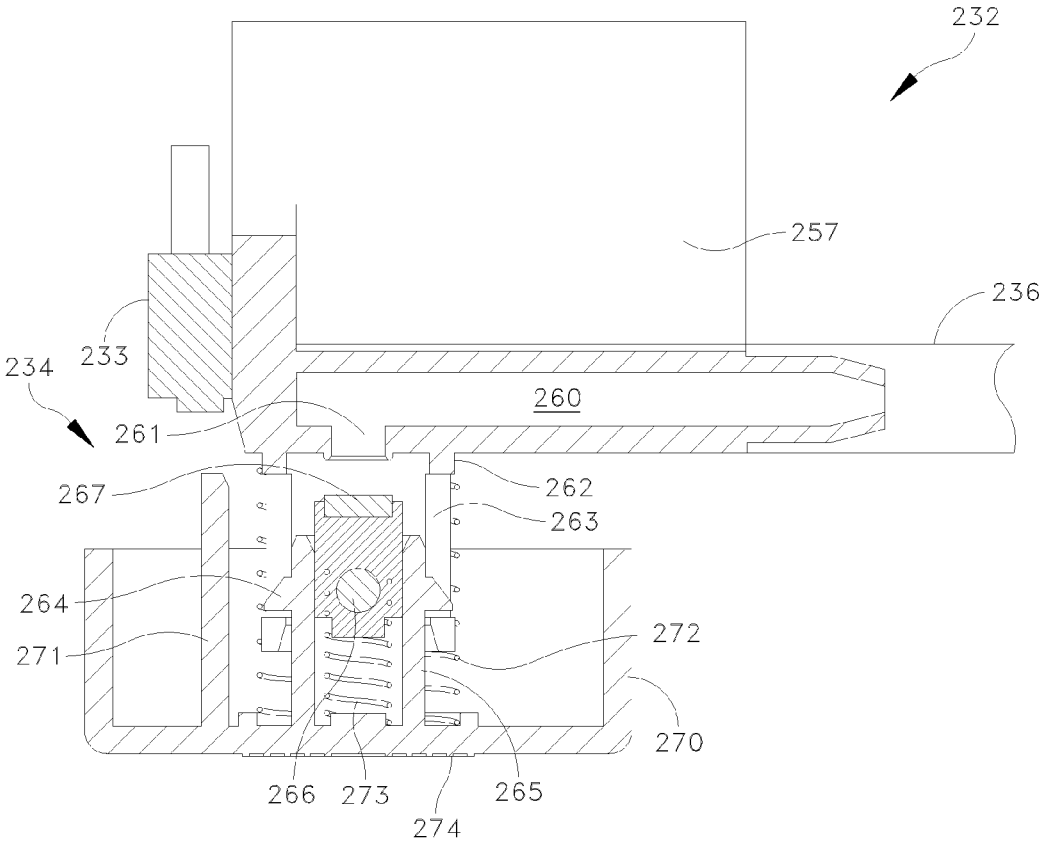
FIG. 27 is a partial sectional view taken along lines 27-27 of FIG. 22.

With respect to the second difference, FIGS. 22 and 27 depict the electro-mechanical controller 232 in greater detail. As specifically shown in FIG. 27, the electro-mechanical controller 232 includes a body portion 257 that carries the micro-switch 233 and that connects to the conduit 235 from the air pump 230 and to the conduit 236 that attaches to the plug 247. The body has an air passage 260 that exits into the conduit 236. A second passage, not shown, extends downwardly to define an air passage from the conduit 235. The body 257 also includes an exhaust port 261 that extends between a portion of the air passage 260 and the atmosphere. That is, the exhaust port 261, when unobstructed, exhausts the air passage 260 to atmosphere.

A pushbutton support structure 262 basically overlies the exhaust port 261 and contains a first set of slots 263 that capture wings 264 on a pushbutton body 265. A pin 266 rides in slots like the slots 263, but displaced 90°.

As a result the pushbutton body 265 can reciprocate in the support structure 262 over a limited range, the maximum displacement of the pushbutton body 265 from the exhaust port 261 being defined by the interference between the wings 264 and the ends of the slots 263. The other end of the pushbutton body 265 carries a sealing pad 267 made of an elastomer or other like material. The body pushbutton body 265 also carries a cup-shaped actuator 270 with a micro-switch actuator 271 extending therefrom in alignment with the actuator of the micro-switch 233.

An outer spring 272 circumscribes the pushbutton support structure 262 to bias the pushbutton actuator 270 to the position shown in FIG. 27 such that the exhaust port 261 is open and the tip of the micro-switch actuator 261 is displaced from the micro-switch 233. An inner spring 273 between the pushbutton body 265 and the pushbutton actuator 270 biases the pushbutton body 265 toward the body portion 257.

In operation, after an individual places a cup proximate the dispensing location 240, such as shown in FIG. 20, the individual depresses a pushbutton actuator finger pad 274. The pushbutton 270 thereby compresses the outer spring 272 until the pad 267 covers the exhaust port 261. At this point the micro-switch actuator 271 is spaced from the micro-switch 233. As the individual continues to depress the push-button actuator 270, the inner spring 273 compresses to perfect the seal at the exhaust port 261. Additional displacement causes the micro-switch actuator 271 to engage and activate the micro-switch 233 energizing the air pump 230. Now air is pumped through the conduit 235, the air passage 260, the conduit 236 and the passages in the plug 247 into the container 40. Liquid then is dispensed as the dispensing location 240.

The individual releases the pushbutton actuator 234 after dispensing the desired amount of liquid. Initially the micro-switch actuator 271 retracts, so the micro-switch 233 shuts down the air pump 230. At this instant, however, pressure remains in the carton 40. However, as the push button body 265 retracts further, the sealing pad 267 opens the exhaust port 261 whereupon air under pressure in the passage 260 vents to the atmosphere. The pressure within the carton 40 immediately reduces to atmospheric pressure terminating the flow of any further liquid through the dispensing tube 245. The effect is that any liquid in the dispensing tube 245 tends to flow back into the carton 40 given the differential heights at the dispensing location 240 and at the bottom of the carton 40. As will now be apparent, the pad 267, exhaust port 261 and related structures provide pneumatic control.

Figure 18:
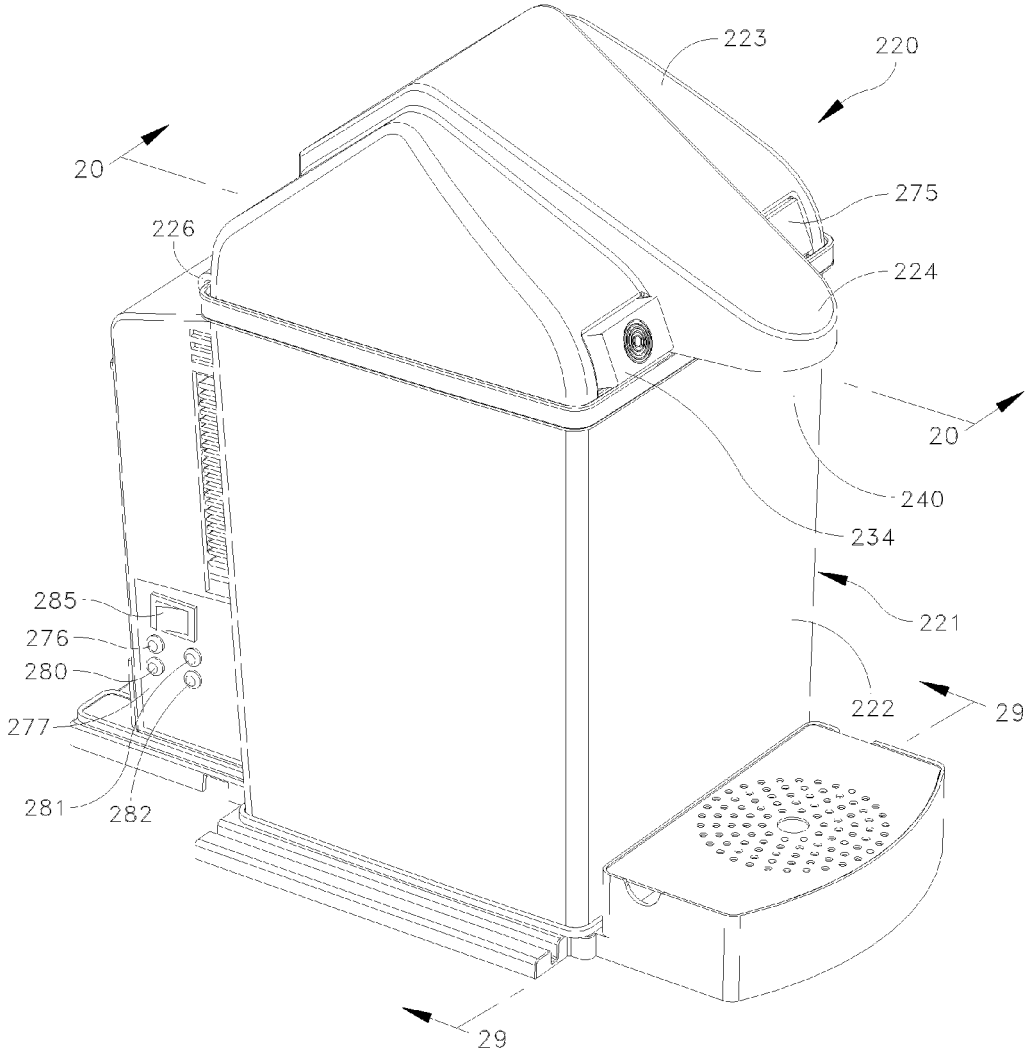
FIG. 18 is a perspective view of an alternative embodiment of a beverage dispensing apparatus constructed in accordance with another aspect of this invention.
Figure 19:
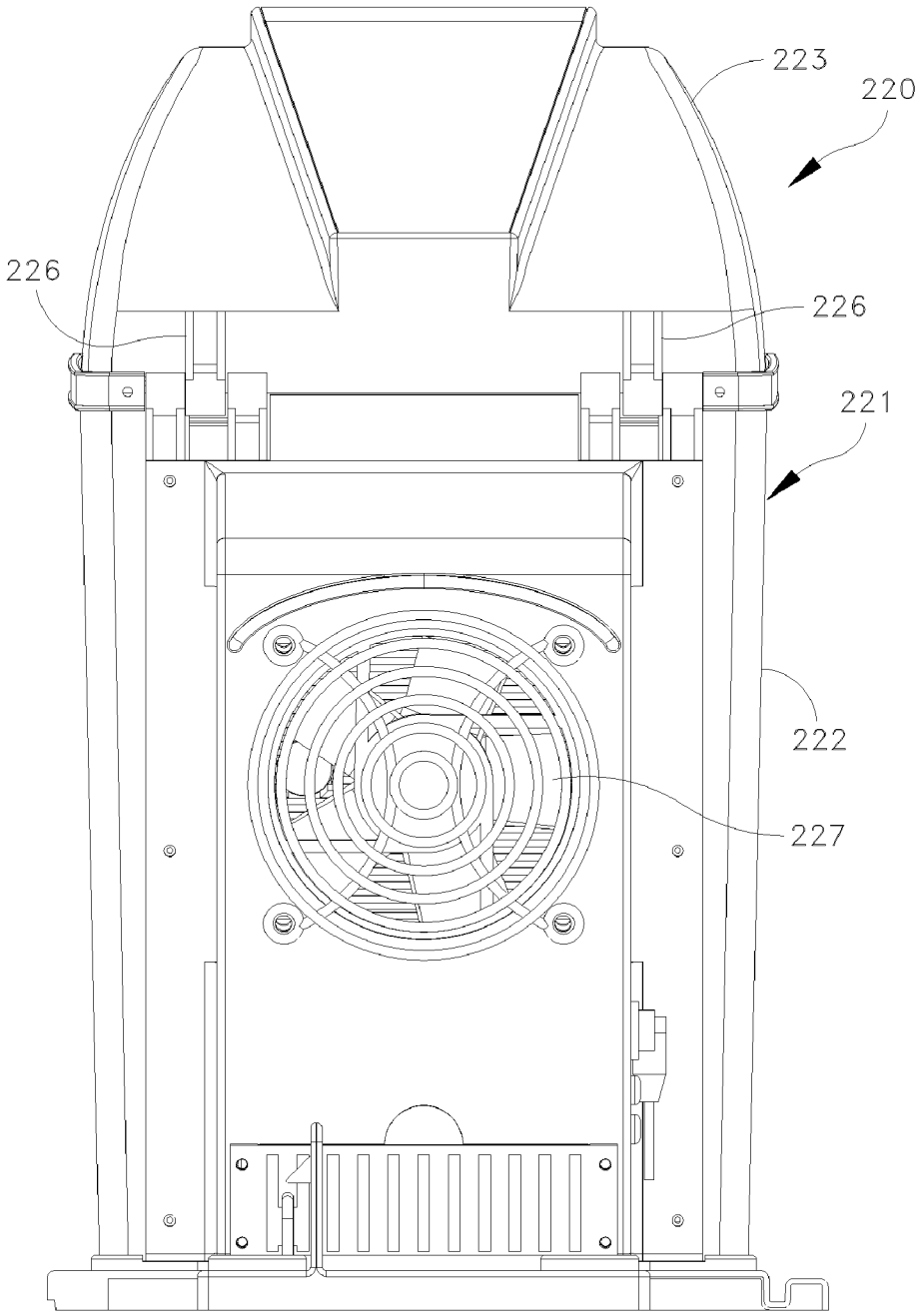
FIG. 19 is a rear plan view of the beverage chilling apparatus of FIG. 19.

FIG. 18 depicts some other features that are incorporated in the alternative embodiment and that could also be incorporated in the embodiment of FIGS. 1 through 17. For example, FIG. 18 depicts a display panel 275 that operates in response to various inputs that occur through the activation of pushbuttons. In one specific embodiment, a pushbutton 276 on a control panel 277 connects to a computer control system that uses the display 275 as an output device. Actuating the pushbutton 276 changes the language that appears in the display 275. It is anticipated that the beverage carton 40 may contain different beverages, such as whole milk, skim milk, cream, etc. Another push button 280 acts in conjunction with the computer control system to display the name of the beverage to be dispensed. Another pushbutton 281 provides a means of establishing default values for the system.

Figure 28:
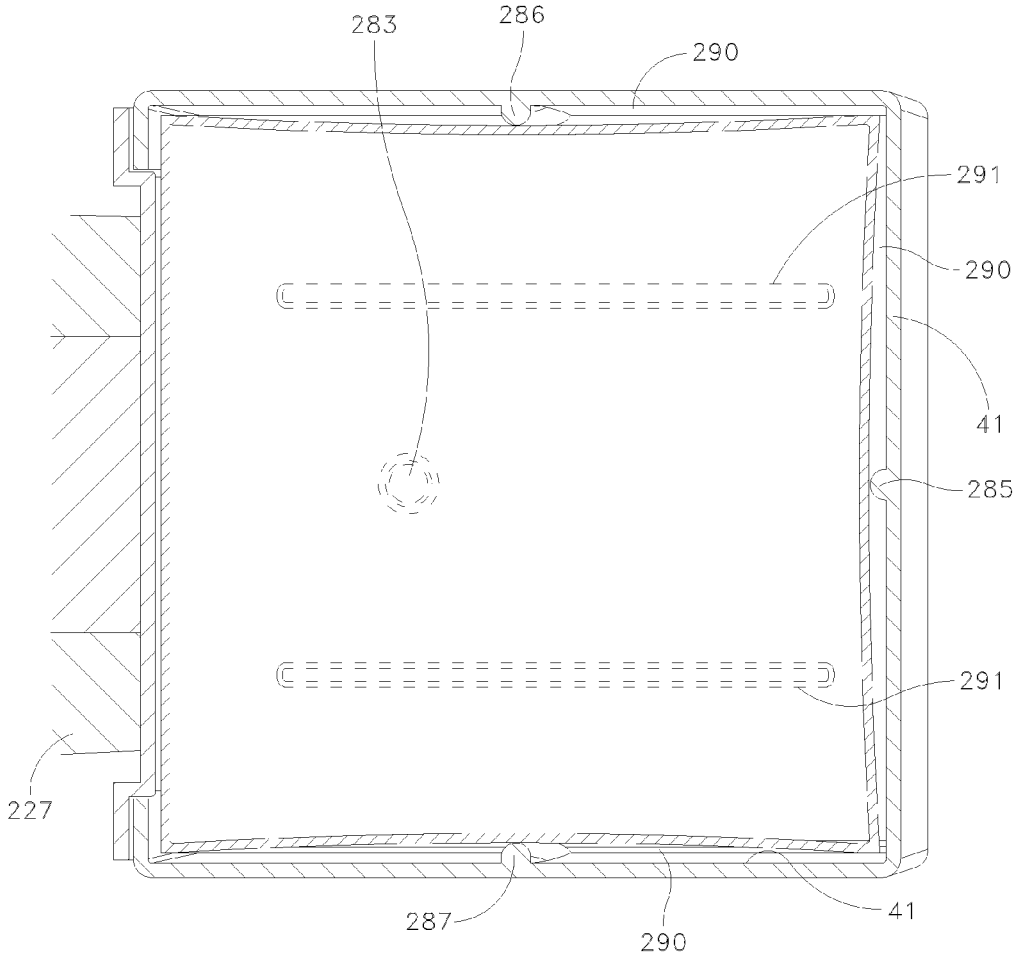
FIG. 28 is a partial sectional view of the beverage dispensing apparatus of FIG. 18 taken with respect to a horizontal plane through the liquid container to depict another feature of this invention.

Still another pushbutton 282 could be included to display the temperature of the liquid. Specifically, as shown in FIG. 20, a temperature sensor 283, also shown in FIG. 28, is disposed in the bottom of the carton 40 and sleeve 41 to provide a temperature indication. FIG. 18 also depicts a power switch 284 for controlling the energization of the beverage dispenser 220. The implementation of these features will be apparent to those skilled in the art.

As will be apparent from particularly FIGS. 18 and 20, many of the features of the apparatus shown in the first embodiment are also incorporated in this embodiment.

Other Alternative Embodiments

Figure 14:
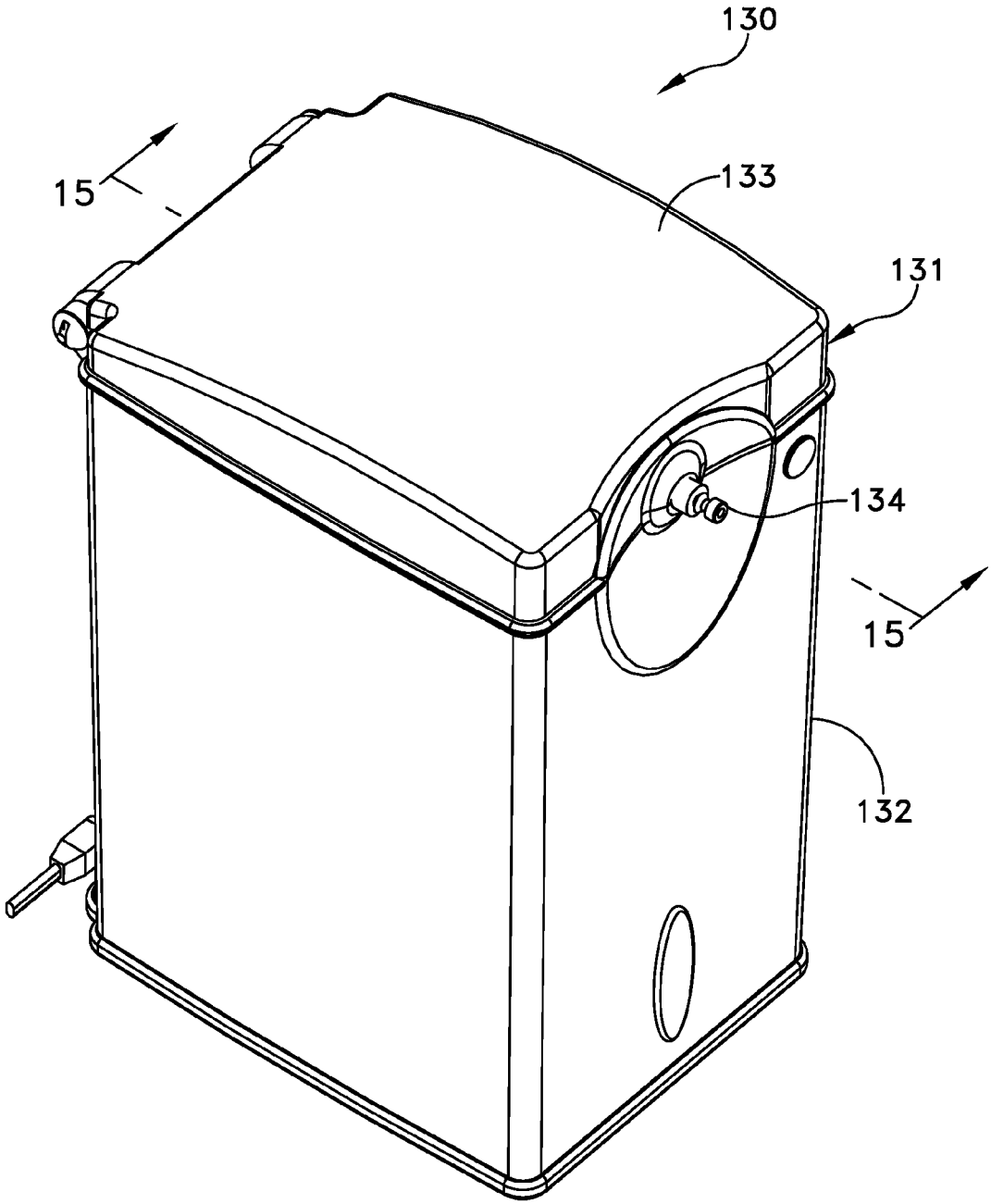
FIG. 14 is a perspective view of another embodiment of this invention.
Figure 15:
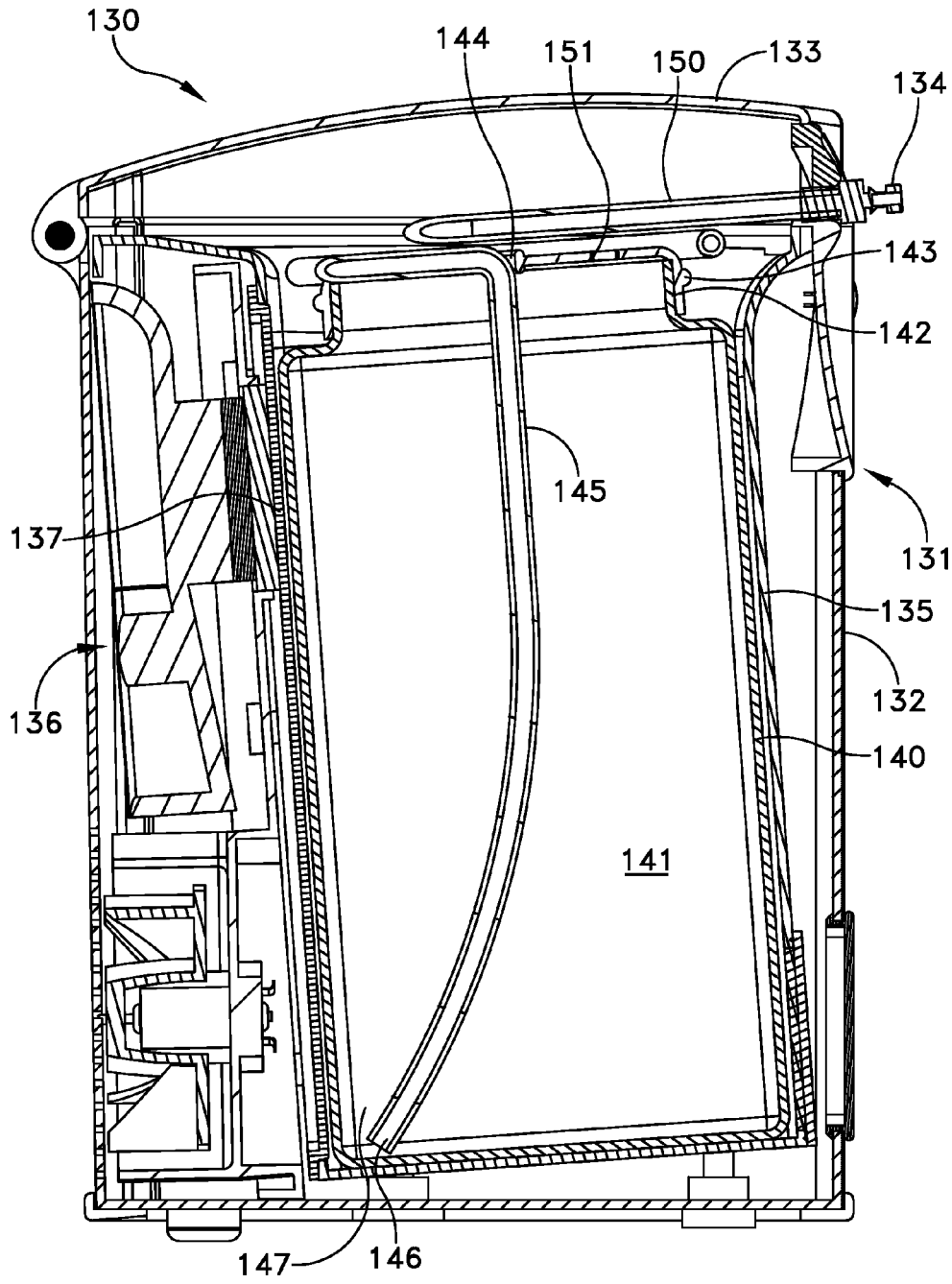
FIG. 15 is a cross section view taken along lines 15-15 in FIG. 14.
Figure 16:
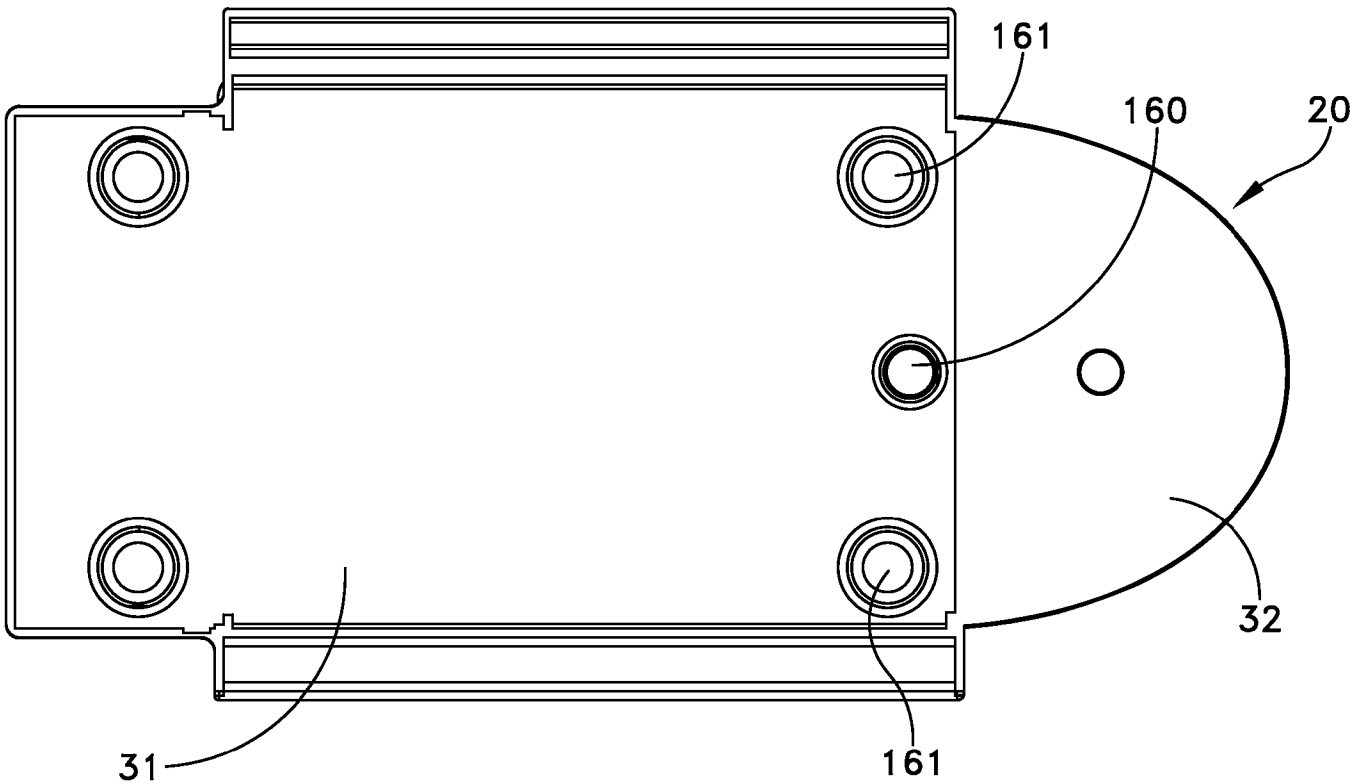
FIG. 16 is a bottom view of the beverage dispenser of FIG. 1 modified to notify personnel that the liquid in the beverage dispenser needs to be replenished.
Figure 17:
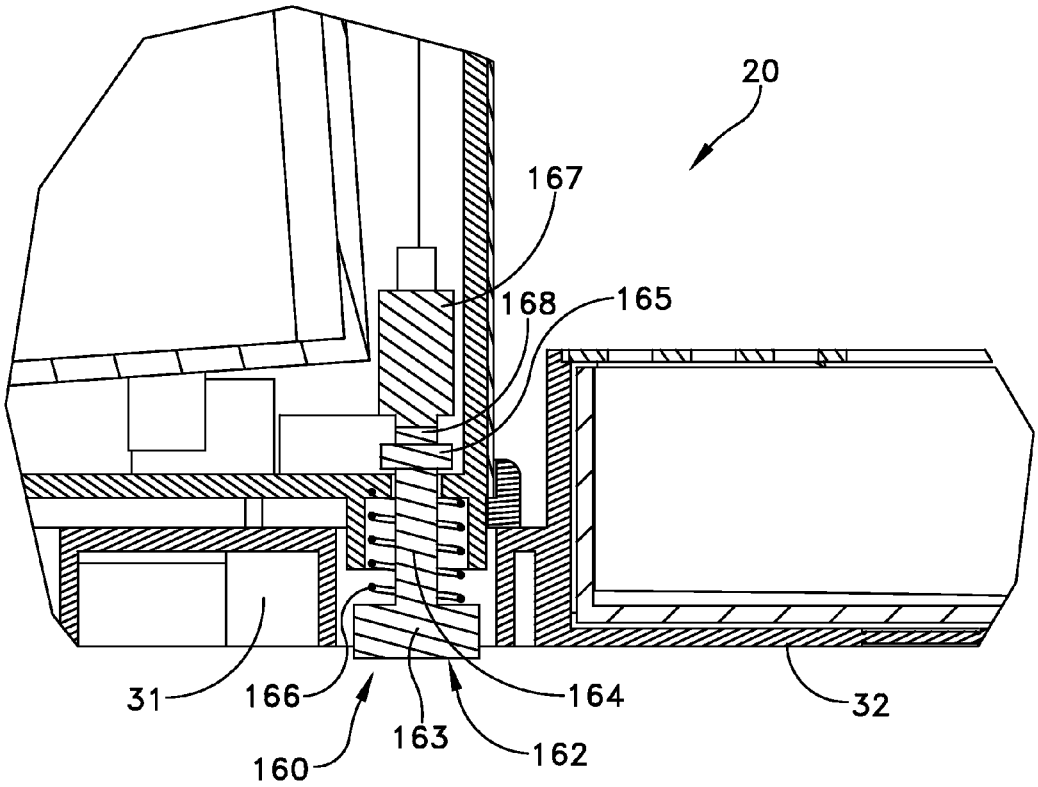
FIG. 17 is an enlarged cross section view taken along lines 17-17 in FIG. 1.

The beverage dispenser shown in FIGS. 1 through 13 produces a pressure differential by means of an air pump thereby to pressurize the interior of the carton 40 with respect to ambient air pressure at the dispensing position 30. FIGS. 14 and 15 depict an alternative beverage dispenser 130 that is adapted for use with a Venturi mixing device, such as shown in espresso machines. The beverage dispenser 130 includes a covered refrigerated housing 131 formed by an outer housing 132 and a cover 133. A fitting 134 is adapted for connection to a Venturi mixing device by a hose or other fluid conduit not shown but known in the art.

Referring specifically to FIG. 15, the outer housing 132 carries an inner sleeve 135 that is canted to the rear. A heat exchanger 136 having a structure corresponding to the structure in FIGS. 1 through 13 includes a cold plate 137. Thus while the heat exchanger 136 is energized, contents of a container 140 remain chilled.

In this particular embodiment, the container 140 is reusable. It includes a main volume 141 for the liquid to be dispensed and a spout 142. A cap 143, when removed, allows the container 140 to be filled. Removable of the cap also facilitates cleaning of the container 140 so in this embodiment the container 140 is reusable.

The cap 147 has a first port 144 that receives a dispensing tube 146. The dispensing tube 146 curves to a bottom inlet portion 146 at a low area 147 of the canted container 140. The dispensing tube 145 exits the container 140 and the cap 143 and connects through a hose 150 to the outlet dispensing fitting 134. The cap 143 additionally includes a second port in the form of a passage 151. Thus when the steam generator in the coffee making apparatus operates, the pressure at the Venturi mixing device reduces. The second port or passage 151, however, maintains the ambient pressure on any liquid in the container 140. Consequently a pressure differential exists that causes liquid in the container to travel through the dispensing tube 145 and the hose 150 to be entrained with steam passing through the Venturi mixing device. When operation terminates, the pressure equalizes and flow stops.

Thus it will be apparent that the embodiment in FIGS. 14 and 15 provides a beverage dispenser that refrigerates a beverage and dispenses that beverage in a controlled manner. The structure is also affordable for use in coffee shops and like businesses, particularly because the container 140 and dispensing tube 145 can be reused. As another feature of this invention, FIG. 28 depicts a preferred embodiment of a modified sleeve 41 that lies against the heat exchanger 227. Each sleeve wall that is remote from the heat exchanger 227 includes a vertical rib. Specifically the sleeve wall opposite the heat exchanger carries a vertical rib 285, disposed at the center of the wall in this embodiment. Similar vertically extending, centrally disposed ribs 286 and 287 are formed in the top and bottom walls as shown in the orientation of FIG. 28. Each of these ribs tends to deflect the walls of the carton inward and away from the wall of the sleeve 41 thereby to form air gaps 290. In addition, the bottom of the sleeve is formed with upstanding ribs 291, as shown in FIGS. 20, 21 and 28. The air gaps 290 and the air gaps adjacent the ribs 291 provide insulation that tends to minimize any heat transfer from the outer walls of the beverage dispenser into the chilled liquid. Rib 285 also supplies a displacement force to maintain intimate contact between the heat exchanger 227 and the carton 40. The three ribs 285, 286 and 287 also tend to maintain the cross section of the carton 40 during pressurization. Consequently, liquid tends to flow immediately upon pressurization without any delay because the ribs 285, 286 and 287 constrain any expansion of the carton 40. These three ribs also allow the sleeve 41 to accommodate size tolerance variations that occur among various cartons.

In another embodiment either the dispenser 20 of FIGS. 1 through 12 or the dispenser 130 of FIGS. 14 and 15 or the dispenser 220 of FIGS. 20 and 21 can incorporate an annunciator for alerting personnel to replenish the contents of the dispenser. Using the dispenser 220 as an example and referring to FIGS. 20 and 29, an annunciator 300 mounts within the outer housing 222 proximate a drip basin assembly 301. The annunciator includes a bridge 302 with a center span 303 and downwardly extending legs 304 and 305. Receptacles 306 and 307 in the base of the beverage dispenser receive the legs 303 and 304, respectively.

Figure 30:
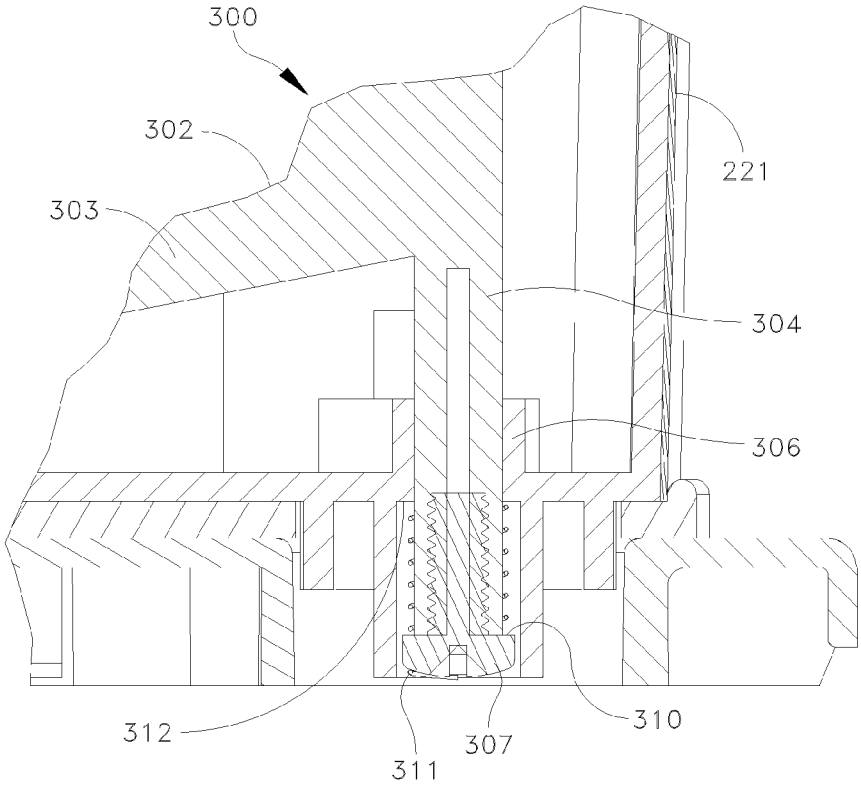
FIG. 30 is an enlarged portion of the partial section of FIG. 29.

Looking at the structure surrounding the leg 304, as more clearly shown in FIG. 30, a machine screw 307 or like device provides a shoulder 310 that performs two functions. First, the shoulder 307 captures a spring 311 along with a shoulder 312 formed on the receiver 304. Second, the machine screw 307 prevents the leg 304 from exiting the top of the receiver 304.

Figure 29:
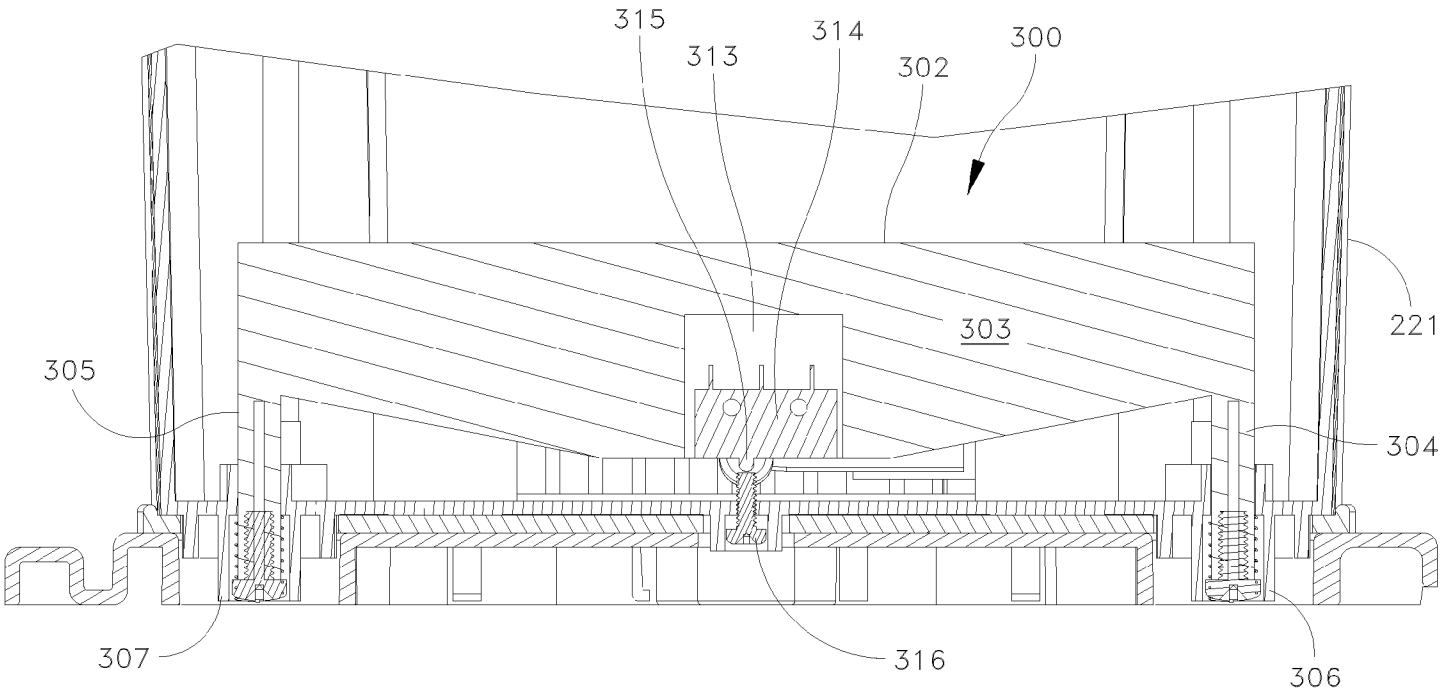
FIG. 29 is a partial section view taken along lines 29-29 in FIG. 18 that depicts still another feature of this invention.

When the carton 40 is full, the combined weights of the beverage dispenser and carton drive the bridge downward into the position show in FIG. 29. As the weight of the carton 40 reduces, eventually the springs on the legs 304 and 305, like the spring 311, elevate the legs 304 and 305 and the integral bridge span 303.

Referring again to FIG. 29, the span 303 includes a central cavity 313 that carries a microswitch 314 with an actuator 315. The base carries a calibrating screw 316. The calibrating screw 316 is positioned, vertically in FIG. 29, such that the actuator 315 just engages the end of the calibrating screw 316 when a carton is in need of replacement. Normally a full carton produces a force on the springs that is greater than the force that will exist when replenishment is required. As the weight reaches that point, the springs will elevate the span 303 until actuator 315 shifts state based on a reduction of pressure exerted by the calibrating screw 316. The state of the microswitch 314 then indicates whether the carton is sufficiently full or needs to be replaced. As will be apparent, the calibrating screw 316 can be adjusted either at a factory or by the user to fine tune the set point which causes the annunciator to indicate the need for a replacement carton. Further details of the annunciator circuit are not included as the implementation of any number of annunciator variations that respond to the condition of a switch, like the microswitch 314 are well known to those skilled in the art.

It will now be apparent that this invention can be implemented with diverse structures. Specific structures have been shown. The specific implementations can be modified by relocation of the disclosed or equivalent structures. While the device has been disclosed as a liquid chilling and dispensing apparatus, it is readily adapted to be a liquid heating and dispensing apparatus by reversing the polarity of the electrical leads feeding the Peltier device and making other minor changes which will be apparent to those of ordinary skill in the art. Thus, while this invention has been disclosed in terms of several embodiments, it will be apparent that many other modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. Apparatus for dispensing the contents of a liquid dairy product container with a spout from a dispensing outlet at the exterior of said apparatus wherein the liquid is subject to spoilage, said dispensing apparatus comprising:

A) covered refrigerated housing means for receiving the container and including means for constraining deformation of the liquid diary product container, B) port means detachably connected to the container at the spout for forming first and second ports into the liquid container through the spout, C) dispensing means for forming a closed path extending from the interior of the liquid container through said first port to the dispensing outlet at the exterior of said housing, and D) pressure differential enabling means attached to said housing remotely from said port means and separated and isolated from said dispensing means for increasing the pressure acting on the liquid dairy product in the liquid container through said second port to a value above the pressure at said dispensing outlet whereby operation of said pressure differential enabling means increases the pressure in the constrained container and on the liquid therein to cause force liquid to be transferred from the liquid container through said dispensing means to the dispensing outlet thereby to emerge from the spout without contacting said pressure differential enabling means.

2. Dispensing apparatus as recited in claim 1 wherein said housing means includes an outer housing and said constraining means includes an inner sleeve for receiving the liquid container.

3. Dispensing apparatus as recited in claim 2 wherein said outer housing has a rear wall and said inner sleeve is canted to position the top of said inner sleeve closer to said outer housing rear wall than a bottom of said inner sleeve.

4. Dispensing apparatus as recited in claim 2 wherein said inner sleeve has a thermally conducting wall for contacting the liquid container and said housing means includes heat exchanging means intermediate said outer housing and said inner sleeve for cooling said thermally conducting wall.

5. Dispensing apparatus as recited in claim 4 wherein said heat exchanger includes:

i. a thermoelectric refrigeration unit and a cold plate connected to one side thereof, said cold plate being in contact with said inner sleeve rear wall, ii. a heat sink connected to the other side of said thermoelectric refrigeration unit, iii. a fan, and iv. flow direction means of said housing for facilitating the flow of air produced by said fan across said heat sink.

6. Dispensing apparatus as recited in claim 4 wherein each inner sleeve wall other than said inner sleeve rear wall has a rib to space a corresponding portion of the container from the corresponding inner sleeve wall.

7. Dispensing apparatus as recited in claim 6 wherein said inner sleeve has a bottom having at least one rib formed thereon to space the bottom of the container from said inner sleeve bottom.

8. Dispensing apparatus as recited in claim 2 additionally including an annunciator connected to said housing that announces the need for replacing the container.

9. Dispensing apparatus as recited in claim 1 wherein dispensing means includes a dispensing tube extending through said first port from the bottom of the liquid container to the dispensing outlet and said housing means includes means for positioning said dispensing tube exteriorly of said housing means.

10. Dispensing apparatus as recited in claim 9 wherein said dispensing tube and said port means form a removable subassembly.

11. Dispensing apparatus as recited in claim 9 wherein said dispensing tube has an inverted J-shape with an elongated leg extending through said first port and a reverse portion that interacts with said positioning means whereby said dispensing tube directs liquid downwardly at said dispensing outlet.

12. Dispensing apparatus as recited in claim 1 wherein said pressure differential means includes an air pump for producing the differential pressure and air passage means for conveying air under pressure from said air pump to said second port.

13. Dispensing apparatus as recited in claim 12 additionally including control means attached to said air passage means and said air pump for controlling the pressurization of the liquid in the liquid container.

14. Dispensing apparatus as recited in claim 13 wherein said air pump includes an electric motor that connects to a power supply and said control means includes electric control means for controlling the energization of said electric motor from the power supply and pneumatic control means for controlling the flow of air through said air passage means.

15. Dispensing apparatus as recited in claim 14 wherein said electric control means includes a switch connected between the power supply and said electric motor and said pneumatic control means includes an exhaust port through said air passage means and wherein control means includes a push button actuator which, when activated, closes said air passage means exhaust port and closes said switch thereby to activate said air pump.

16. Dispensing apparatus as recited in claim 15 wherein said pushbutton means includes spring means for displacing said pushbutton upon release thereby to open said switch and uncover said air passage exhaust port thereby to terminate the flow of liquid from said dispensing outlet.

17. Dispensing apparatus as recited in claim 1 wherein said outer housing has an open top and said housing means includes a cover hinged to said outer housing for rotation between an open position for enabling the insertion and removal of the liquid container from said housing means and a closed position for covering the outer housing.

18. Dispensing apparatus for chilled liquids in a liquid container with a spout wherein the liquid is subject to spoiling comprising:

A) an outer housing,

B) a thermoelectric heat exchanger in said housing having a cold side and a hot side wherein a heat sink attaches to the hot side and a fan directs air across the heat sink, C) a sleeve in said housing that receives the liquid container and constrains the deformation thereof, a portion of the liquid container being in contact with said cold side thereby to chill the liquid in the liquid container, D) a stopper that engages the liquid container spout and closes the opening through the spout, said stopper including pressurization and dispensing tube ports therethrough, E) an air pump and conduit that direct air under pressure through said pressurization port thereby to increase the pressure in the liquid container and on the liquid, F) a dispensing tube separated and isolated from said air pump and conduit for forming a closed path from a bottom portion of the liquid container through said dispensing tube port to the spout whereby operation of said air pump forces liquid dairy product in the liquid container to be dispensed from said dispensing apparatus through a dispensing outlet thereby to emerge from the spout without contacting said air pump.

19. Dispensing apparatus as recited in claim 18 wherein said sleeve is canted in said outer housing and said dispensing tube extends to the lowest portion of the liquid container.

20. Dispensing apparatus as recited in claim 18 wherein said sleeve includes a plurality of walls and said portion thereof in contact with said cold side constitutes a rear wall, each wall other than said rear wall having a rib to space a corresponding portion of the container from the corresponding wall.

21. Dispensing apparatus as recited in claim 18 wherein said sleeve has a bottom having at least one rib formed thereon to space the bottom of the liquid container from said sleeve bottom.

22. Dispensing apparatus as recited in claim 18 wherein said stopper and said dispensing tube are formed as a single subassembly.

23. Dispensing apparatus as recited in claim 18 including indicia that indicate the specific liquid in the liquid container.

24. Dispensing apparatus as recited in claim 18 including means for indicating a need for replacing the liquid container in the sleeve with another liquid container.

25. Dispensing apparatus as recited in claim 24 wherein said indicating means includes:

i) a switch having first and second states, ii) means responsive to the weight of said dispensing apparatus for controlling the state of said switch.

26. Dispensing apparatus as recited in claim 18 additionally an electro-mechanical controller attached to said conduit and said air pump for controlling the pressurization of the liquid in the liquid container.

27. Dispensing apparatus as recited in claim 26 wherein said air pump includes an electric motor that connects to a power supply and said electro-mechanical controller includes an electric control that controls the energization of said electric motor from the power supply and a mechanical control that controls the flow of air through said conduit.

28. Dispensing apparatus as recited in claim 27 wherein said electric control includes a switch connected between the power supply and said electric motor and said mechanical control includes an exhaust port through said conduit and wherein controller includes a push button actuator which, when activated, closes said exhaust port and said switch in sequence thereby to activate said air pump and pressurize the liquid in the liquid container.

29. Dispensing apparatus as recited in claim 28 wherein said pushbutton actuator includes spring means for displacing said pushbutton upon release thereby to open said switch and uncover said exhaust port thereby to terminate the flow of liquid from said dispensing outlet and terminate the pressurization of the liquid in the liquid container.

* * * * *